US011130048B2

(12) United States Patent
Singh et al.

(10) Patent No.: US 11,130,048 B2
(45) Date of Patent: Sep. 28, 2021

(54) THREE-DIMENSIONAL PUZZLE CONTAINING MOVEABLE ELEMENTS

(71) Applicants: Amit Singh, Coto de Caza, CA (US); Robert Douglas Stewart, Etobicoke (CA)

(72) Inventors: Amit Singh, Coto de Caza, CA (US); Robert Douglas Stewart, Etobicoke (CA)

(73) Assignees: Amit Singh, Coto de Caza, CA (US); Robert Douglas Stewart, Etobicoke (CA)

( * ) Notice: Subject to any disclaimer, the term of this patent is extended or adjusted under 35 U.S.C. 154(b) by 0 days.

(21) Appl. No.: 16/577,155

(22) Filed: Sep. 20, 2019

(65) Prior Publication Data

US 2020/0094132 A1 Mar. 26, 2020

Related U.S. Application Data

(60) Provisional application No. 62/740,265, filed on Oct. 2, 2018, provisional application No. 62/734,636, filed on Sep. 21, 2018.

(51) Int. Cl.
*A63F 9/12* (2006.01)
*A63F 11/00* (2006.01)

(52) U.S. Cl.
CPC ..... *A63F 9/1208* (2013.01); *A63F 11/0074* (2013.01); *A63F 2011/0079* (2013.01); *A63F 2250/245* (2013.01)

(58) Field of Classification Search
CPC ..... A63F 9/1208; A63F 11/0074; A63F 2250/245; A63F 2011/0079; A63F 2009/0815; A63F 9/0811; E05B 37/0048; E05B 37/02
See application file for complete search history.

(56) References Cited

U.S. PATENT DOCUMENTS

| | | | |
|---|---|---|---|
| D116,469 | S | 9/1939 | Wightman |
| D222,999 | S | 2/1972 | Tachi |
| 3,717,942 | A | 2/1973 | Presby |
| 4,149,717 | A | 4/1979 | Seijiro |

(Continued)

FOREIGN PATENT DOCUMENTS

| | | | |
|---|---|---|---|
| EP | 3395417 | A1 | 10/2018 |
| FR | 1290228 | A | 4/1962 |
| FR | 2241326 | A1 | 3/1975 |

*Primary Examiner* — Steven B Wong

(74) *Attorney, Agent, or Firm* — Sterne, Kessler, Goldstein & Fox P.L.L.C.

(57) ABSTRACT

Systems, devices, and methods including one or more code rings, each code ring comprising one or more sides on an outer surface and one or more code ring alignment indentations on an inner surface; and one or more inner combination rings, each inner combination ring comprising one or more inner combination ring alignment protrusions on an outer surface and a combination indentation on an inner surface; where each of the one or more code ring alignment indentations receive each of the one or more inner combination ring alignment protrusions, where each inner combination ring may be removable and rotatable relative to each code ring of the one or more code rings, and where the combination indentation may be proximate an unlocked side of each of the one or more code rings.

8 Claims, 31 Drawing Sheets

(56) References Cited

U.S. PATENT DOCUMENTS

D274,073 S 5/1984 Tung
D280,996 S 10/1985 Epstein
5,116,053 A * 5/1992 Blankenburg ..... A63F 9/0811 273/153 S
D350,994 S 9/1994 Conotter
D353,164 S 12/1994 Meei-Lin
D359,315 S 6/1995 Tacey
D366,506 S 1/1996 Lindquist
D393,003 S 3/1998 Nichols
5,934,120 A * 8/1999 Kuo ..... E05B 37/02 70/30
6,209,368 B1 * 4/2001 Lee ..... E05B 37/025 70/30
6,378,866 B1 * 4/2002 Graham-Ward .... A63F 3/00697 273/153 R
6,799,446 B1 * 10/2004 Tsai ..... E05B 37/02 70/26
6,845,643 B2 * 1/2005 Tsai ..... E05B 37/0031 70/26
7,107,803 B1 * 9/2006 Swanson ..... E05B 37/02 70/163
7,252,204 B1 * 8/2007 Small ..... B65D 55/145 206/459.5
7,337,637 B2 * 3/2008 Kan ..... E05B 37/025 70/30
D660,919 S 5/2012 Perrin
8,302,967 B2 * 11/2012 Kim ..... A63F 9/083 273/153 S
8,517,193 B1 * 8/2013 Small ..... E05B 37/025 215/206
9,186,573 B2 * 11/2015 Perkins ..... A63F 9/001
9,562,369 B2 * 2/2017 Kuo ..... E05B 37/0048
D794,134 S 8/2017 Wang
10,188,937 B1 * 1/2019 Whitney ..... A63F 9/08
10,639,561 B2 * 5/2020 Moore ..... A63H 33/26
2003/0038423 A1 2/2003 Turner et al.
2003/0227131 A1 * 12/2003 Han ..... A63F 9/083 273/153 S
2005/0278186 A1 * 12/2005 de la Huerga ..... A63F 9/18 705/25
2005/0288082 A1 * 12/2005 de la Huerga ..... A63F 9/0811 463/9
2009/0127783 A1 5/2009 Paquette
2020/0282299 A1 * 9/2020 Morris ..... A63F 9/0666

* cited by examiner

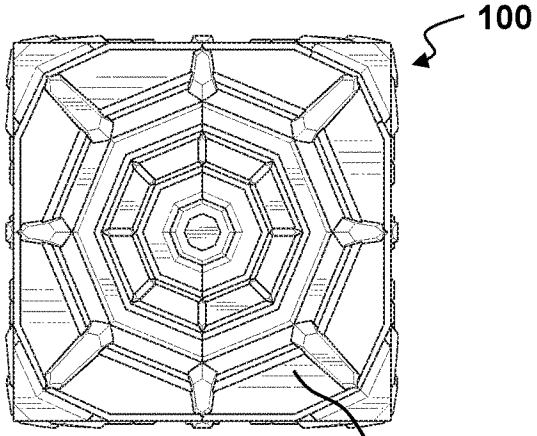
FIG. 9A
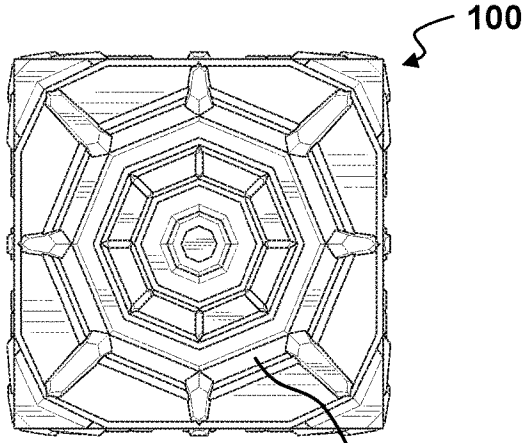
FIG. 9B
FIG. 9C
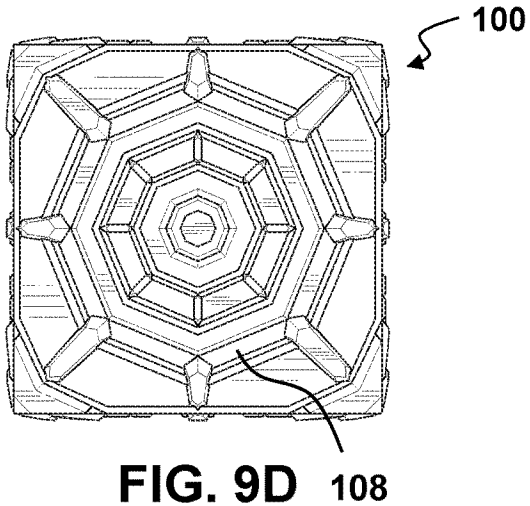
FIG. 9D
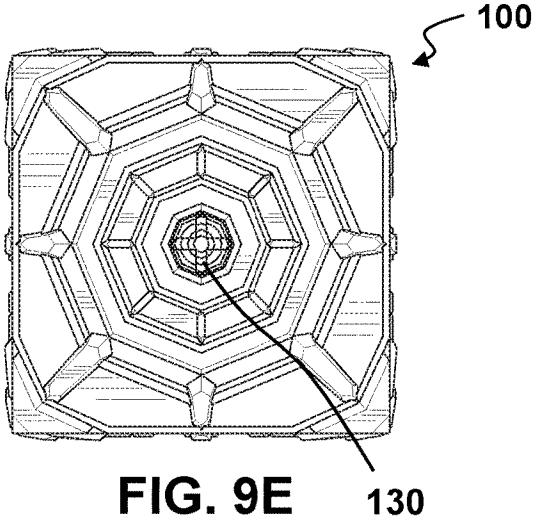
FIG. 9E
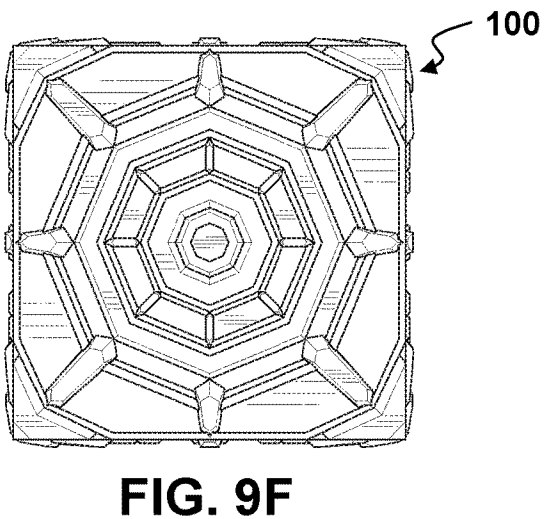
FIG. 9F

THREE-DIMENSIONAL PUZZLE CONTAINING MOVEABLE ELEMENTS

CROSS-REFERENCE TO RELATED APPLICATIONS

This application claims priority to and the benefit of U.S. Provisional Patent Application No. 62/734,636, filed Sep. 21, 2018 and U.S. Provisional Patent Application No. 62/740,265, filed Oct. 2, 2018, the contents of which are hereby incorporated by reference herein for all purposes.

TECHNICAL FIELD

Embodiments relate generally to toys, and more particularly to puzzles having a combination lock.

BACKGROUND

Three-dimensional puzzles may consist of a set of pieces, which may be manipulated into different combinations by a group of operations. For example, a three-dimensional puzzle may be solved by achieving a particular combination starting from a random combination. The mechanical construction of the puzzle may define the rules by which the combination of pieces may be altered.

SUMMARY

A system embodiment may include: one or more code rings, each code ring comprising one or more sides on an outer surface and one or more code ring alignment indentations on an inner surface; and one or more inner combination rings, each inner combination ring comprising one or more inner combination ring alignment protrusions on an outer surface and a combination indentation on an inner surface; where each of the one or more code ring alignment indentations receive each of the one or more inner combination ring alignment protrusions, where each inner combination ring may be removable and rotatable relative to each code ring of the one or more code rings, and where the combination indentation may be proximate an unlocked side of each of the one or more code rings.

In additional system embodiments, the one or more code rings may include two or more code rings. In additional system embodiments, the one or more inner combination rings may include two or more inner combination rings. Additional system embodiments may include: a first cylinder comprising one or more cylinder protrusions; and a second cylinder comprising a channel, where the first cylinder fits inside the second cylinder, and where the one or more cylinder protrusions of the first cylinder extend beyond an outer diameter of the second cylinder. Additional system embodiments may include: a securing ring detachably attached to the second cylinder, where the one or more code rings are disposed about the second cylinder, and where the securing ring holds the one or more code rings in place about the second cylinder. Additional system embodiments may include: a top key; and a first cap, where the first cap may be attached to the first cylinder, and where the top key may be configured to detach the first cap from the first cylinder.

In additional system embodiments, the one or more code rings may be disposed about the second cylinder, and the one or more cylinder protrusions of the first cylinder may fit into each combination indentation on the inner surface of each of the one or more inner combination rings. Additional system embodiments may include: a first border disposed on an inner surface of each of the one or more inner combination rings; and a second border disposed on an inner surface of each of the one or more inner combination rings; where the first border and the second border form a channel, and where the one or more cylinder protrusions of the first cylinder fit within the channel when the combination indentation may be proximate a locked side of the code ring.

In additional system embodiments, the first cylinder may be detachable from the second cylinder when the unlocked side of each of the one or more code rings may be aligned with the one or more cylinder protrusions of the first cylinder. In additional system embodiments, a combination to detach the first cylinder from the second cylinder may be varied by rotation of each inner combination ring relative to each code ring of the one or more code rings, where the combination comprises the unlocked side of each of the one or more code rings aligned with each of the one or more cylinder protrusions of the first cylinder.

A method embodiment may include: removing a first cylinder from a second cylinder; removing one or more code rings from the second cylinder; removing an inner combination ring from a code ring of the one or more code rings; rotating the inner combination ring relative to the code ring of the one or more code rings; inserting the inner combination ring into the code ring of the one or more code rings; returning the one or more code rings to the second cylinder; and attaching the first cylinder to the second cylinder.

Additional method embodiments may include: removing a first cap from the first cylinder via a top key. Additional method embodiments may include: detaching a securing ring from the second cylinder, where the securing ring retains the one or more code rings about the second cylinder. In additional method embodiments, removing the first cylinder from the second cylinder may further include: aligning an unlocked side of each of the one or more code rings with an indicator, where a combination indentation on an inner surface of the combination ring may be proximate the unlocked side of each of the one or more code rings.

Another system embodiment may include: one or more clue cards disposed in one or more compartments of a puzzle; a cryptex disposed in the puzzle, the cryptex comprising one or more rings corresponding to the one or more clue cards; and an item disposed in a compartment in the cryptex, where the item may be revealed when the one or more rings of the cryptex are aligned according to the one or more clue cards and the cryptex may be opened.

Additional system embodiments may include: a first key; and a first keyhole, where the first key may be configured to engage the first keyhole to remove the cryptex from the puzzle. In additional system embodiments, the first key may be a combination of two or more keys disposed in one or more compartments of the puzzle, and where the first keyhole accepts the combination of the two or more keys.

Additional system embodiments may include: one or more moveable elements, where the one or more moveable elements may be moved by at least one of: pushing, pulling, sliding, and rotating the one or more moveable elements. In additional system embodiments, the one or more compartments may be accessed via movement of the one or more moveable elements. Additional system embodiments may include: an item accessory disposed in the one or more compartments of the puzzle, where the item accessory may be configured to be added to the item disposed in the compartment in the cryptex.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which:

FIGS. 9A-9F depict front, rear, left, right, top, and bottom views, respectively, of the puzzle of FIG. 1, according to one embodiment;

DETAILED DESCRIPTION

The disclosed device, system, and method provide for a puzzle having an adjustable combination. The puzzle may have one or more rings with each ring having one or more faces. Aligning the correct faces on each ring may cause the puzzle to open and reveal an item hidden inside the puzzle. The adjustable combination allows a user, or another user, to re-use the puzzle. The rings may be removed from the puzzle and adjusted so that a different face or each ring becomes a new correct face to open the puzzle.

The disclosed device, system, and method also provide for a three-dimensional puzzle containing one or more moveable elements that may be engaged to reveal a key, a key portion, a keyhole, a compartment, a door, a handle, an item accessory, and a clue card. The moveable elements of the puzzle may include a push element, a pull element, a slide element, a rotatable element, a key, a handle, a magnet, a door, and/or a light. The revealed elements may be used in a linear or non-linear sequence to reveal a cryptex sequence. In a linear sequence, each step must be performed in a set order. In the non-linear sequence, two or more actions may be made possible and not dependent upon a set order for solving one or more stages of the three-dimensional puzzle. The cryptex may be solved using one or more clue cards discovered during solving the puzzle. Pulling apart the solved cryptex reveals one or more items disposed in a compartment within the cryptex. One or more item accessories discovered during solving the puzzle may be added to the revealed item. In some embodiments, the puzzle shape and form factor may be varied and include, but not be limited to, a geometric shape, an animal, a car, a robot, a horse, etc. In some embodiments, the number of steps required to reveal the cryptex and the revealed item using the moveable elements and revealed elements may be varied based on the desired difficulty level, etc.

Figure 1:
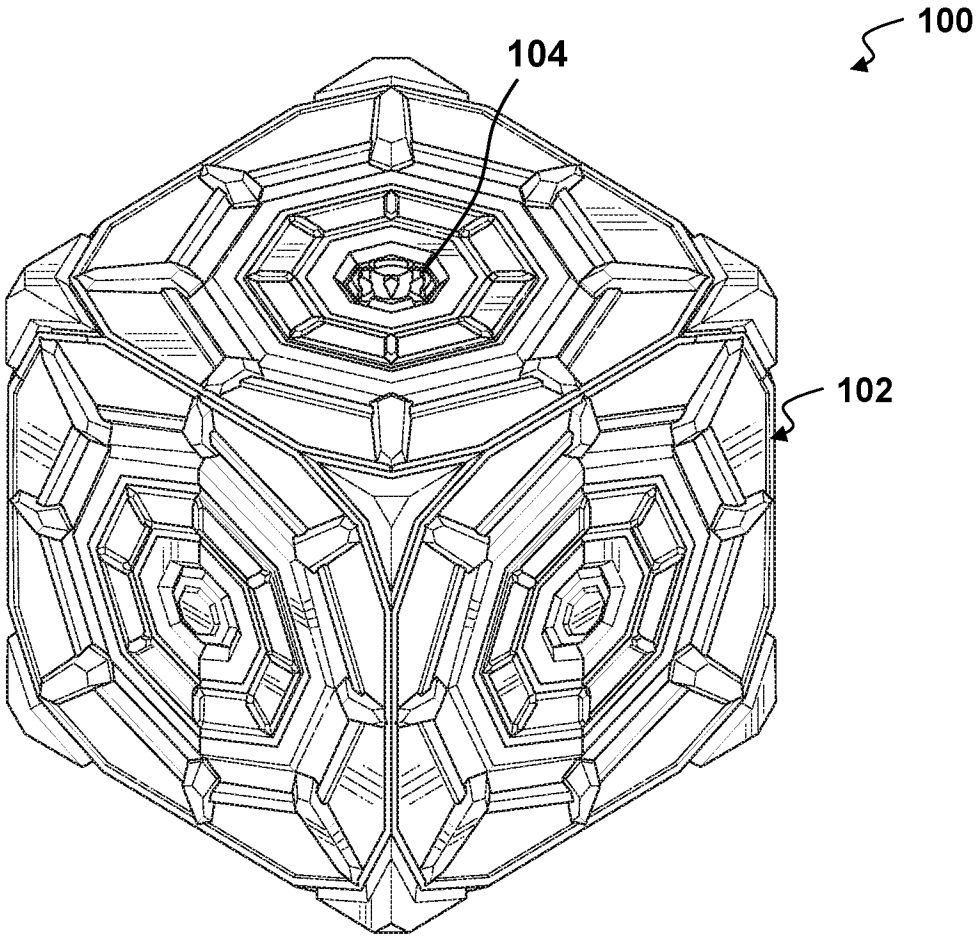
FIG. 1 depicts a perspective view of a puzzle, according to one embodiment.

FIG. 1 depicts a perspective view of a puzzle 100, according to one embodiment. The puzzle 100 is a three-dimensional puzzle and may be any shape or size, such as a geometric shape, an animal, a car, a robot, a horse, etc. An outer surface 102 of the puzzle 100 may include one or more moveable elements. The one or more moveable elements may appear as standard parts of the exterior surface 102. It may not be readily apparent that the exterior surface 102 contains moveable elements that may be pushed, pulled, slid, and/or rotated. A user handling the puzzle 102 may try pushing, pulling, sliding, or rotating various elements in order to unveil additional elements and progress through the puzzle 102.

In some embodiments, the puzzle 102 may be solved in a linear manner, where each step must be performed in a set order. In other embodiments, the puzzle 102 may be solved in a non-linear manner with two or more actions being possible and not dependent upon a set order for solving one or more stages of the puzzle 102. In some embodiments, one or more elements may be visible, such as a second keyhole 104, which are not used until the later stages of the puzzle 100.

Figure 2:
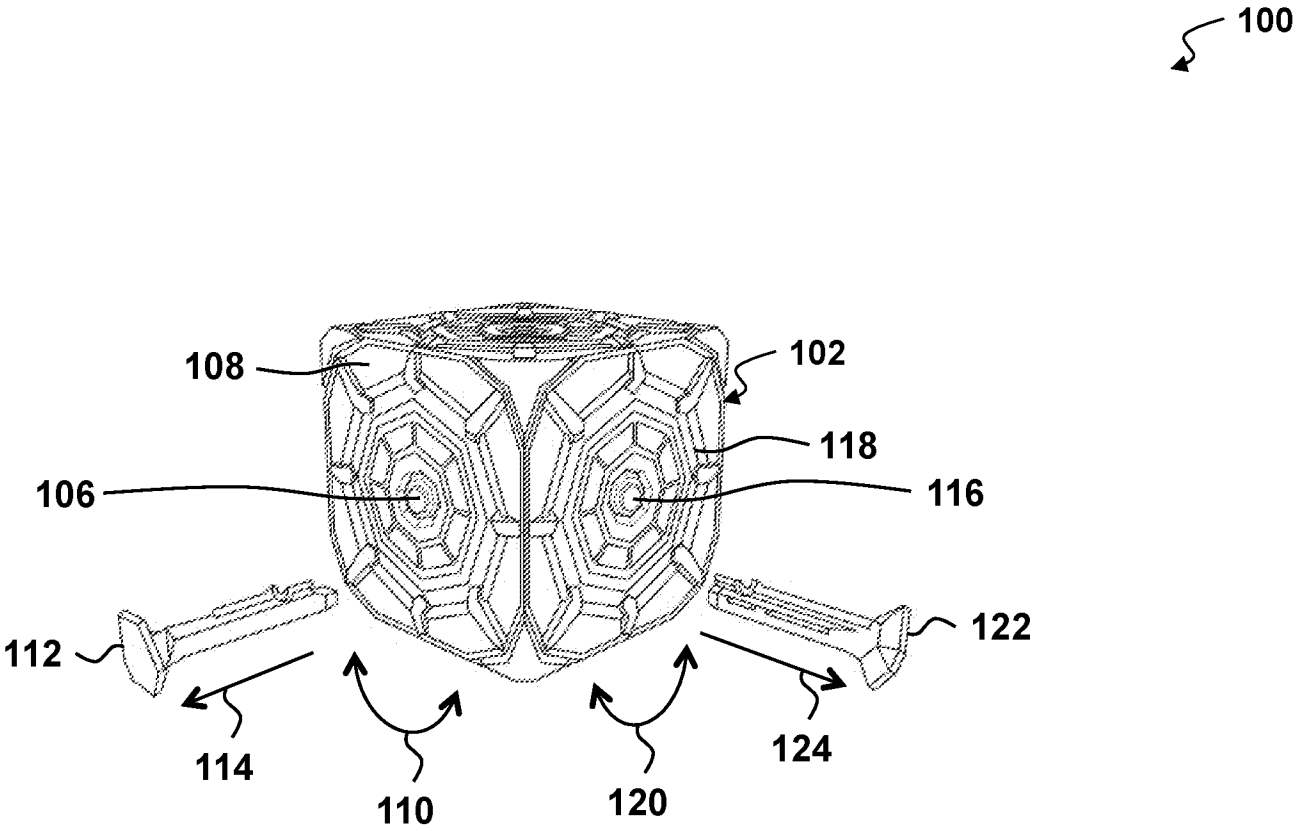
FIG. 2 depicts a perspective view of the puzzle of FIG. 1 with the first and second keys removed, according to one embodiment.

FIG. 2 depicts a perspective view of the puzzle 100 of FIG. 1 with the first and second keys removed, according to one embodiment. A first button 106 may be pressed allowing a first rotatable element 108 to rotate 110 relative to the outer surface 102 of the puzzle 100. Rotation 110 of the first rotatable element 108 causes a first key 112 to extend 114 from the puzzle outer surface 102. A second button 116 may be pressed allowing a second rotatable element 118 to rotate 120 relative to the outer surface 102 of the puzzle 100. Rotation 120 of the second rotatable element 118 causes a second key 122 to extend 124 from the puzzle outer surface 102. In some embodiments, the buttons 106, 116 may be spring-loaded to extend when pressed.

In some embodiments, pressing the first and second buttons 106, 116 may cause the first and second keys 112, 122 to extend 114, 124 from the outer surface 102 of the puzzle 100. In other embodiments, rotating the first and second rotatable elements 108, 118 may cause the first and second keys 112, 122 to extend 114, 124 from the outer surface 102 of the puzzle 100. In other embodiments, pulling the first and second keys 112, 112 may allow them to extend 114, 124 from the outer surface 102 of the puzzle 100.

Figure 3:
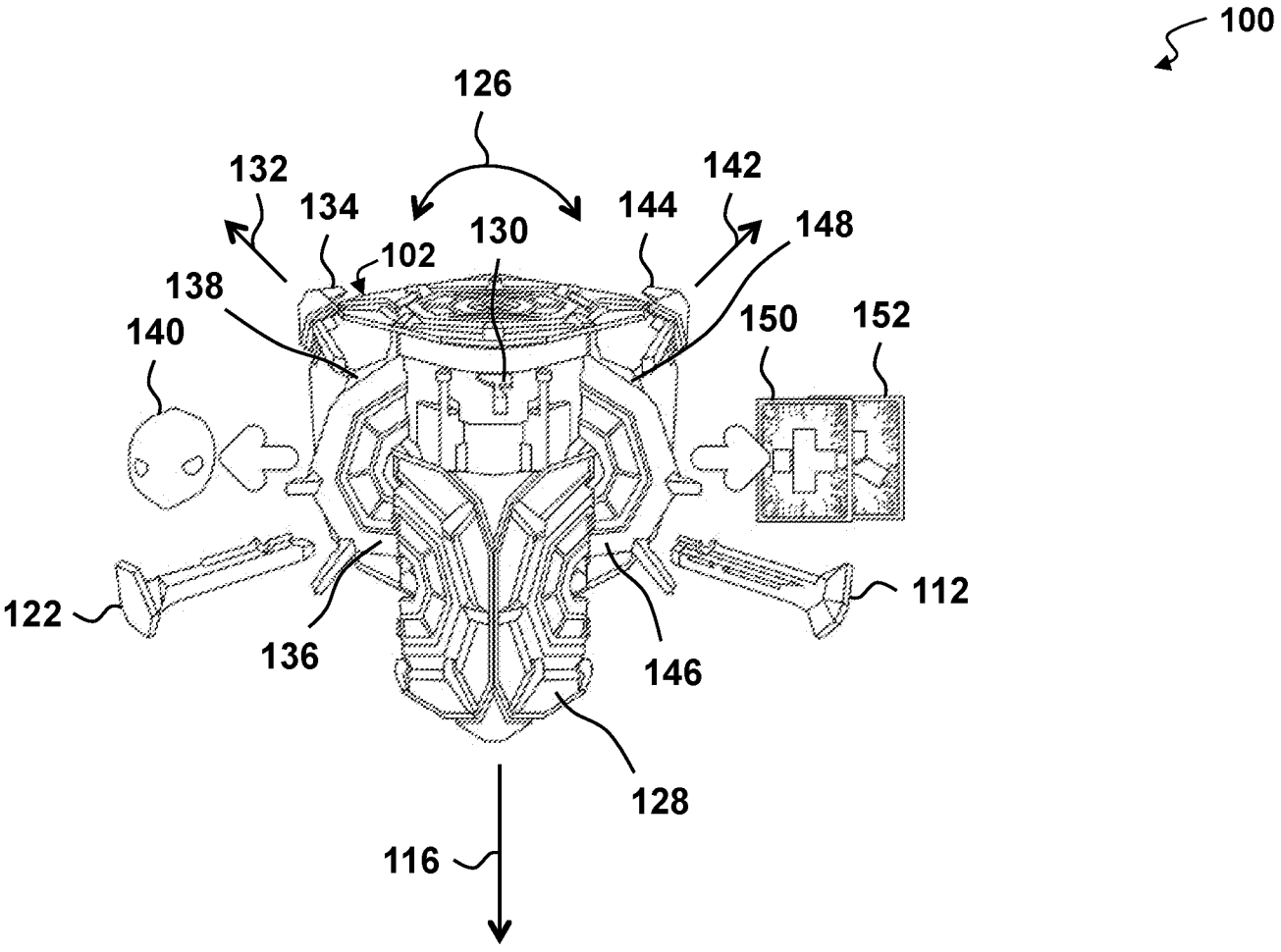
FIG. 3 depicts a perspective view of the puzzle of FIG. 1 with an edge popped out and slid down, a first keyhole revealed, a first door opened to reveal a first compartment, a first item accessory removed from the first compartment, a second door opened to reveal a second compartment, and a first and second clue card removed from the second compartment, according to one embodiment.

FIG. 3 depicts a perspective view of the puzzle 100 of FIG. 1 with an edge popped out and slid down, a first keyhole revealed, a first door opened to reveal a first compartment, a first item accessory removed from the first compartment, a second door opened to reveal a second compartment, and a first and second clue card removed from the second compartment, according to one embodiment. The puzzle 100 may be rotated 126 to allow access to and visual inspection of an opposite side. Depressing one or more buttons 106, 116 may allow an edge 128 to pop and slide 116 down out relative to the outer surface 102 of the puzzle 100. The movement of the edge 128 reveals a first keyhole 130. The first keyhole 130 may not fit the first key 112 or the second key 122 individually.

Sliding 132 a first corner 134 out relative to the outer surface 102 of the puzzle 100 may open a first door 136 and reveal a first compartment 138. A first item accessory 140 may be disposed inside the first compartment 138. Sliding 142 a second corner 144 out relative to the outer surface 102 of the puzzle 100 may open a second door 146 and reveal a second compartment 148. A first clue card 150 and a second clue card 152 may be disposed inside the second compartment 148. In some embodiments, compartments 138, 148 may include one or more item accessories, clue cards, keys, magnets, lights, etc. In other embodiments, the compartments 138, 148 may be empty or may appear to be empty.

Figure 4:
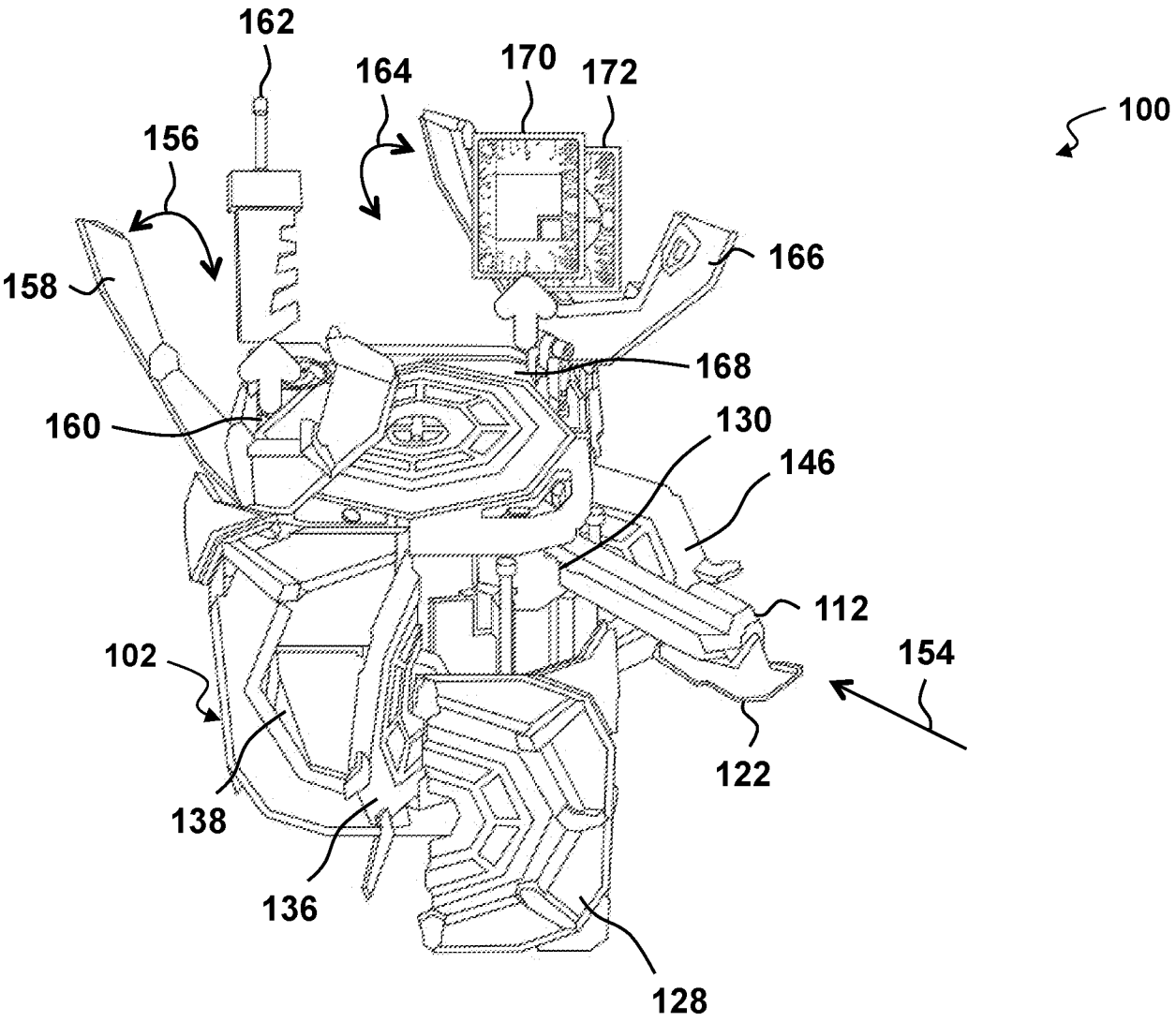
FIG. 4 depicts a perspective view of the puzzle of FIG. 1 with first and second keys combined and inserted into the first keyhole, a third door opened to reveal a third compartment, a second item accessory removed from the third compartment, a fourth door opened to reveal a fourth compartment, and a third and fourth clue card removed from the fourth compartment, according to one embodiment.

FIG. 4 depicts a perspective view of the puzzle 100 of FIG. 1 with first and second keys combined and inserted into the first keyhole, a third door opened to reveal a third compartment, a second item accessory removed from the third compartment, a fourth door opened to reveal a fourth compartment, and a third and fourth clue card removed from the fourth compartment, according to one embodiment. The first and second keys 112, 122 may be combined to form a key that fits the first keyhole 130. The combined key 112, 122 may be inserted 154 into the keyhole. Pushing the combined key 112, 122 into the keyhole, or rotating the combined key 112, 122 in the keyhole may open 156 a third door 158 and reveal a third compartment 160. A second item accessory 162 may be disposed inside the third compartment 160. Pushing the combined key 112, 122 into the keyhole, or rotating the combined key 112, 122 in the keyhole may also open 164 a fourth door 166 and reveal a fourth compartment 168. A third and fourth clue card 170, 172 may be disposed inside the fourth compartment 168. The third and fourth doors 158, 166 may be rotated or pivoted away from the outer surface 102 of the puzzle 100.

Figure 5:
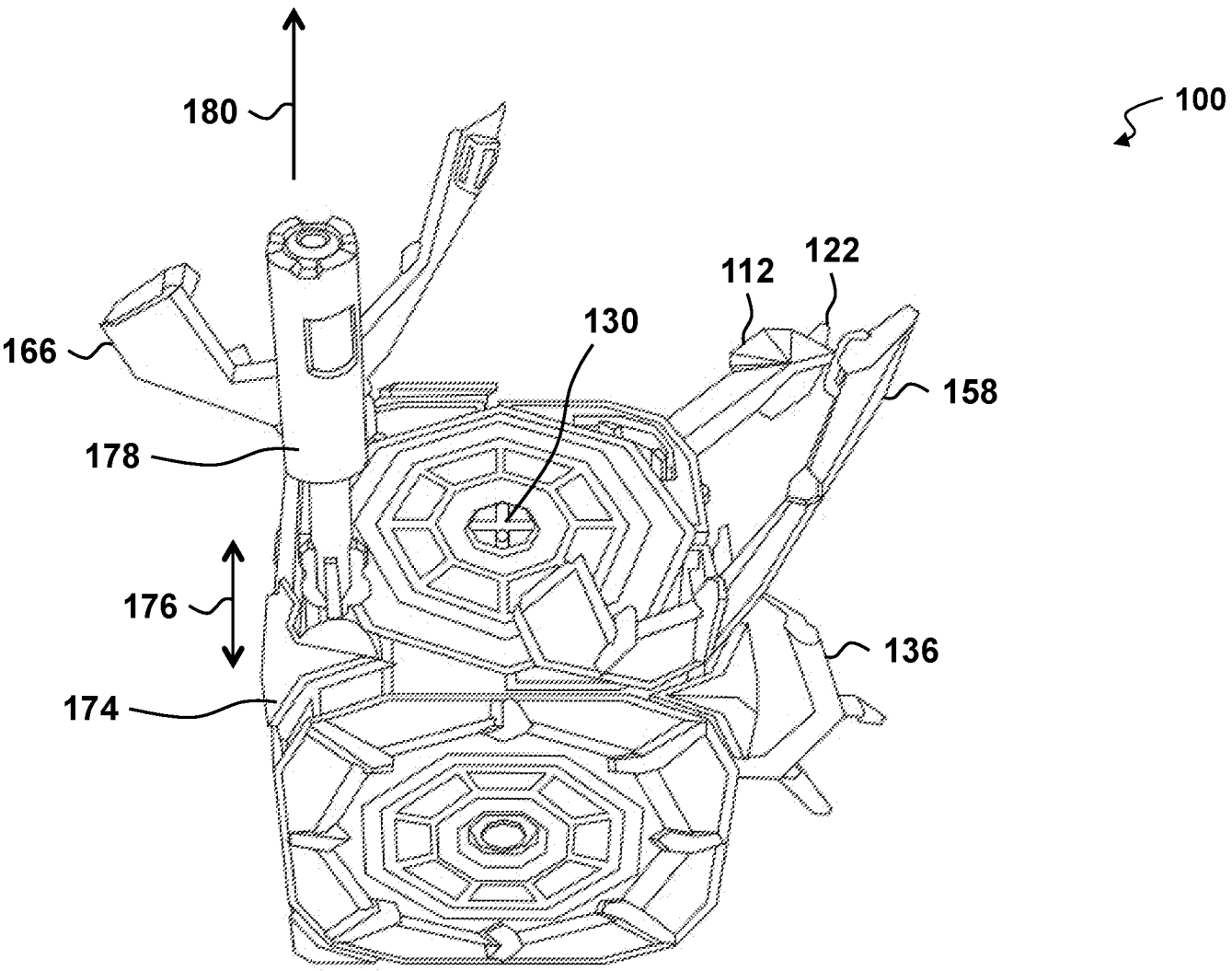
FIG. 5 depicts a perspective view of the puzzle of FIG. 1 with a third key removed, according to one embodiment.

FIG. 5 depicts a perspective view of the puzzle 100 of FIG. 1 with a third key removed, according to one embodiment. A corner handle 174 may be raised 176 to reveal a third key 178. The third key 178 may be removed 180 from the puzzle 100. In some embodiments, the third key 178 may include one or more indentations or extrusions that correspond to one or more extrusions or indentations in the puzzle. Removing the third key 178 may require twisting, turning, pushing, and/or pulling on the third key 178 so that the third key 178 can be removed from the puzzle 100.

Figure 6:
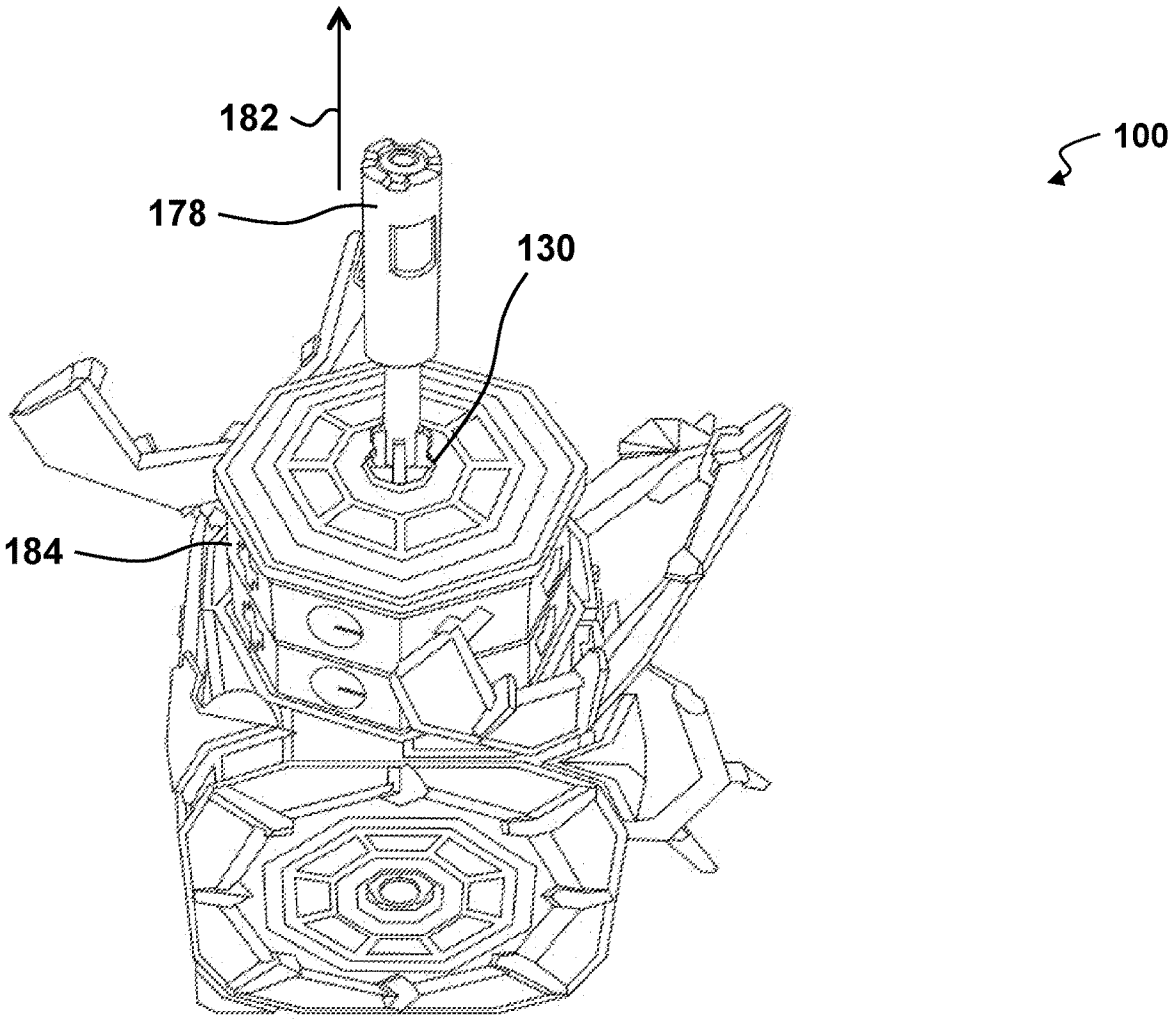
FIG. 6 depicts a perspective view of the puzzle of FIG. 1 with the third key inserted into a second keyhole, turned, and pulled to remove a cryptex, according to one embodiment.

FIG. 6 depicts a perspective view of the puzzle 100 of FIG. 1 with the third key inserted into a second keyhole, turned, and pulled to remove a cryptex, according to one embodiment. The third key 178 is inserted into the second keyhole 130, turned, and pulled 182 to reveal a cryptex 184.

Figure 7:
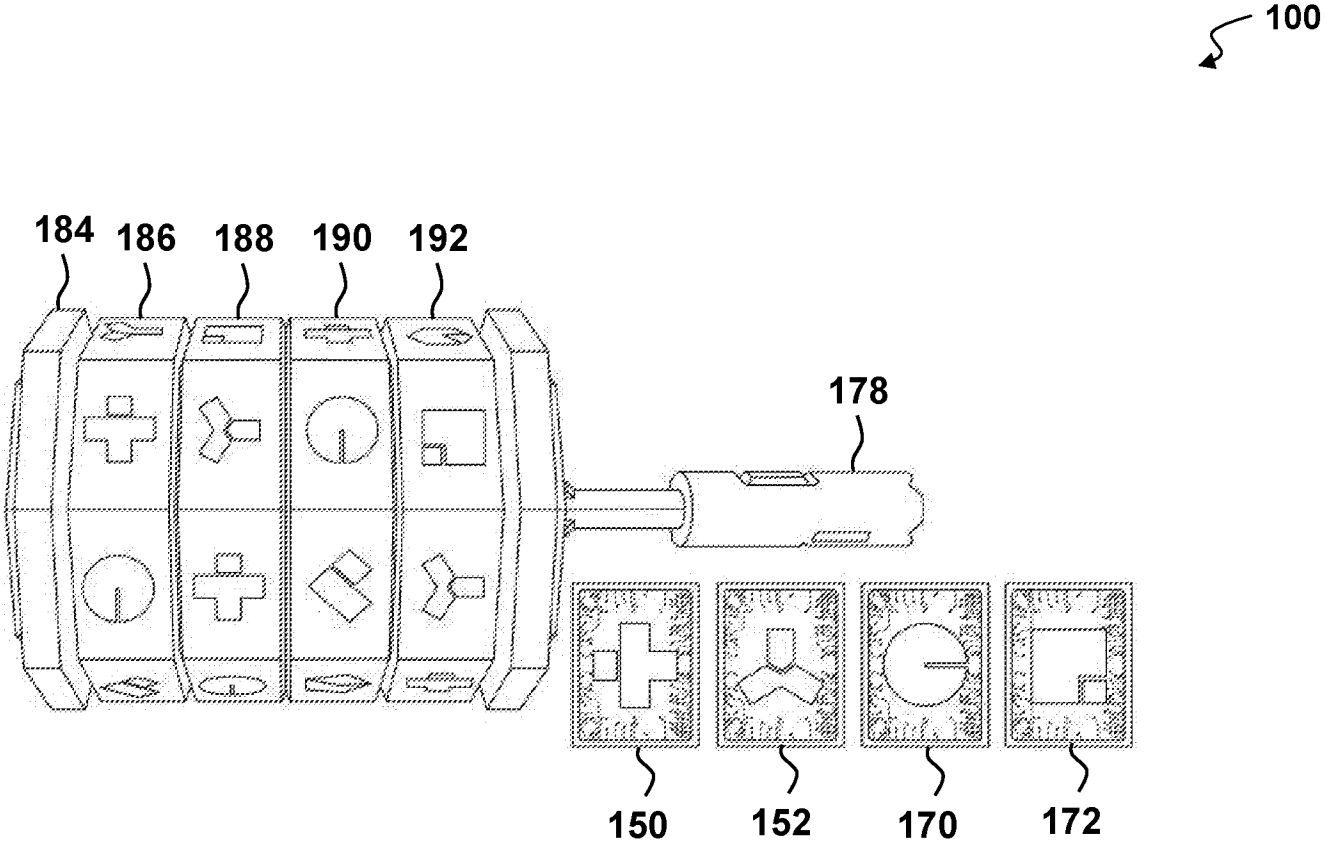
FIG. 7 depicts a perspective view of the puzzle of FIG. 1 with the rings of the cryptex rotated to match the clue cards, according to one embodiment.

FIG. 7 depicts a perspective view of the puzzle 100 of FIG. 1 with the rings of the cryptex rotated to match the clue cards, according to one embodiment. The cryptex 184 may include one or more rings 186, 188, 190, 192, which may be rotated to correspond to the one or more clue cards 150, 152, 170, 172 discovered in compartments while solving the puzzle 100. In some embodiments, the number of rings 186, 188, 190, 192 on the cryptex 184 may correspond to the number of clue cards 150, 152, 170, 172 hidden in the puzzle 100. In other embodiments, a user may discover the correct cryptex 184 combination by guessing, clues on the packaging, clues on a mobile application and/or website on a user device, etc.

Figure 8:
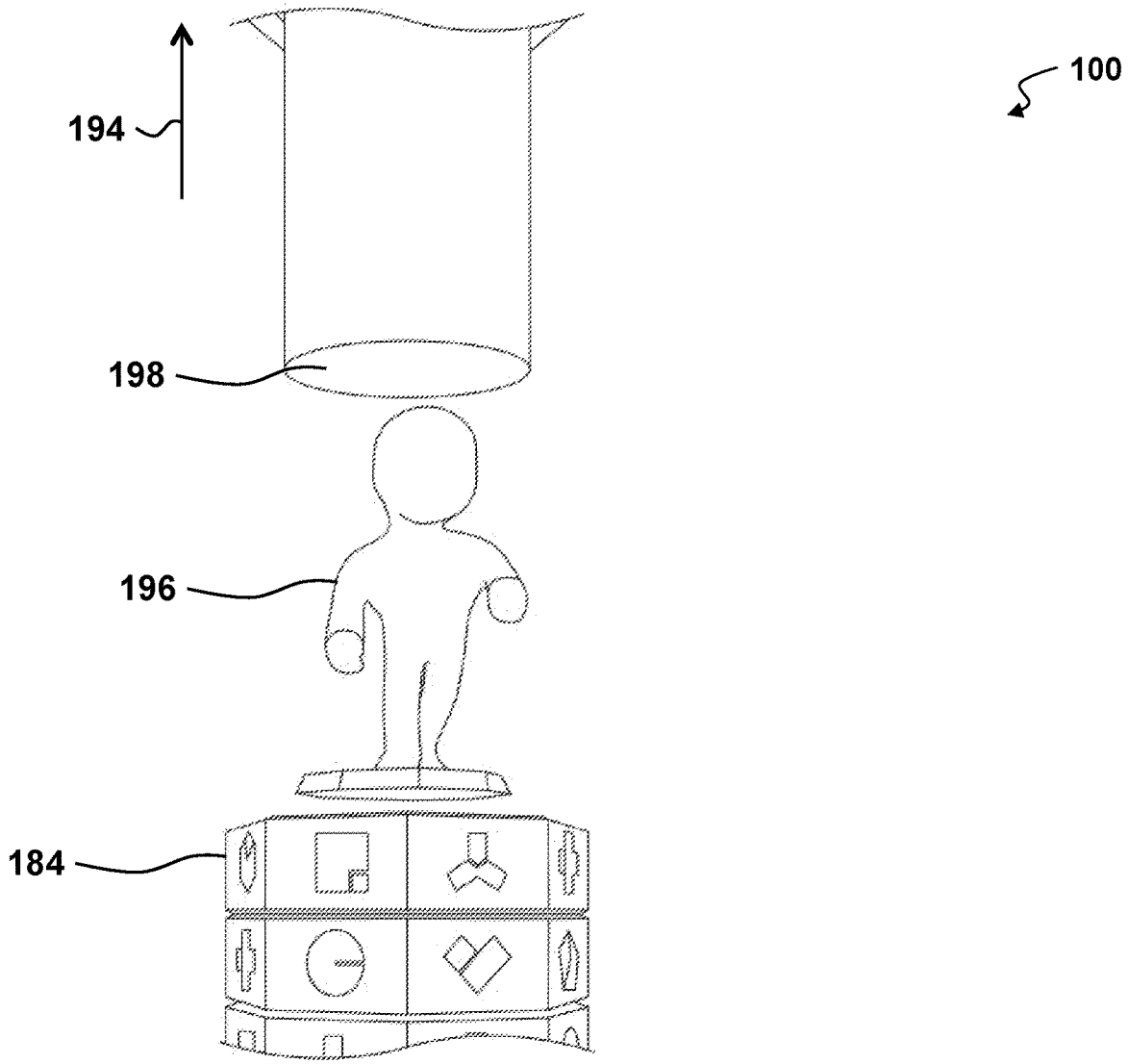
FIG. 8 depicts a perspective view of the puzzle of FIG. 1 with the solved cryptex opened to reveal an item inside the cryptex, according to one embodiment.

FIG. 8 depicts a perspective view of the puzzle 100 of FIG. 1 with the solved cryptex opened to reveal an item inside the cryptex, according to one embodiment. The solved cryptex 184 may be opened 194 to reveal an item 196 inside a compartment 198 in the cryptex. The item accessories (140, 162, FIGS. 3-4) may be added to the item 196.

FIGS. 9A-9F depict front, rear, left, right, top, and bottom views, respectively, of the puzzle 100 of FIG. 1, according to one embodiment. In some embodiments, each face of the puzzle 100 may appear substantially the same. In other embodiments, one or more elements, such as the second keyhole 130, may provide an orientation for the user.

Figure 10:
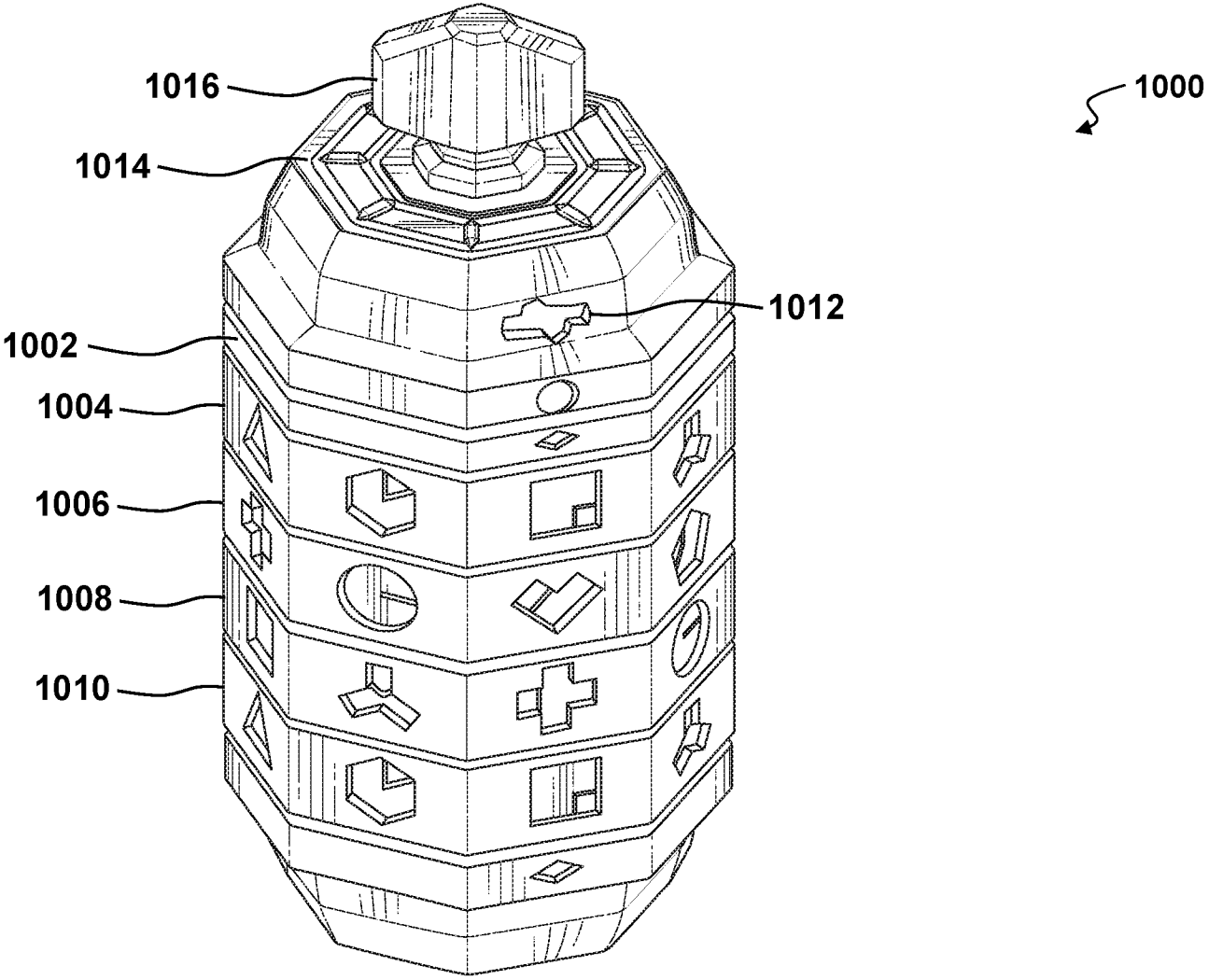
FIG. 10 depicts a perspective view of an alternate embodiment of a puzzle, according to one embodiment.
Figure 11C:
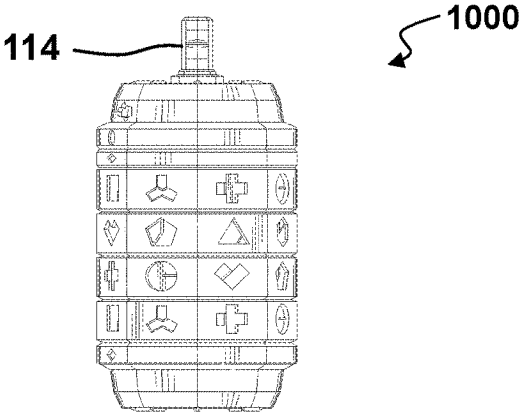
FIGS. 11A-11F depict top, bottom, front, rear, right, and left views, respectively, of the puzzle of FIG. 10, according to one embodiment.
Figure 11B:
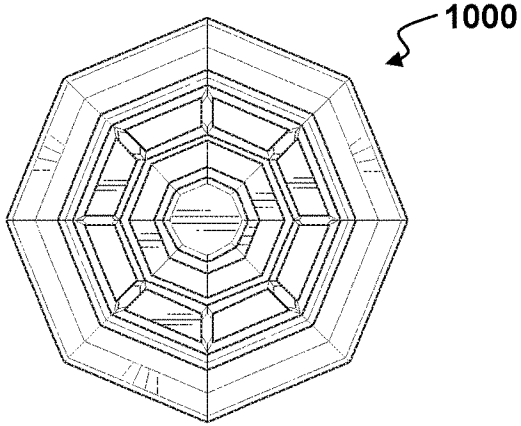
Figure 11A:
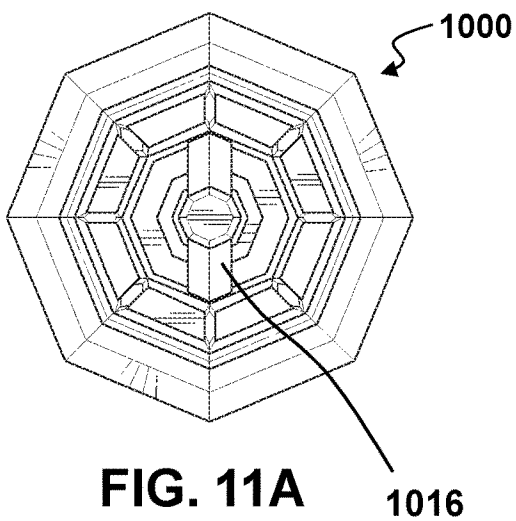
Figure 11F:
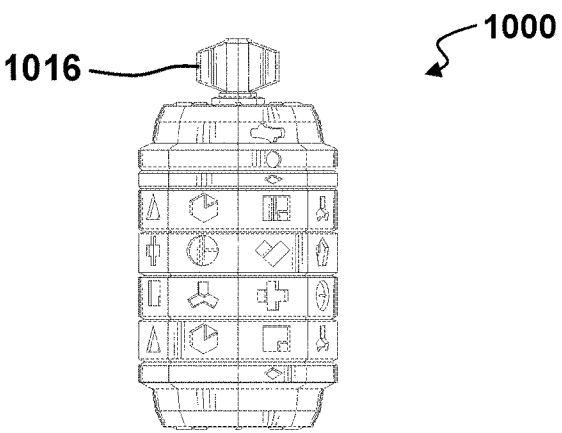
Figure 11E:
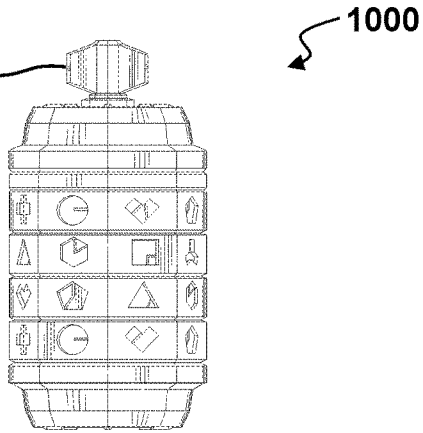
Figure 11D:
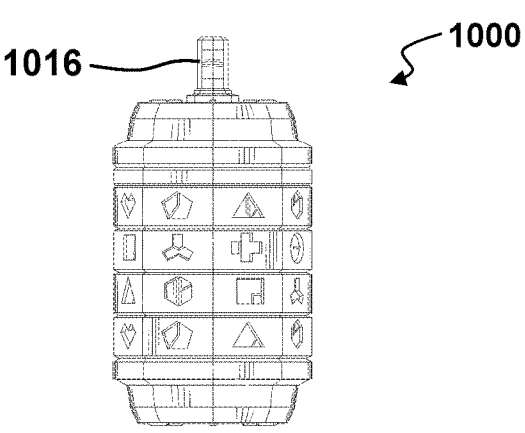

FIG. 10 depicts a perspective view of an alternate embodiment of a puzzle 1000, according to one embodiment. The puzzle 1000 may include a visible cryptex 1002. The cryptex 1002 may include one or more rings 1004, 1006, 1008, 1010. The puzzle 1000 may also include a visible keyhole 1012. The puzzle 1000 may also include a lid 1014 and a knob 1016. Twisting, pulling, and/or rotating the knob 1016 may reveal a key that fits the keyhole 1012. Using the key attached to the knob 1016 as leverage, the lid 1014 may be rotated relative to the cryptex 1002 until the lid is separated from the cryptex 1002 revealing one or more compartments. The one or more compartments may include item accessories, clue cards, etc. In one embodiment, the one or more compartments may include a decoder, such as a transparent film with a color, and encoded clue cards, such as clue cards with lines in a number of colors. Viewing the encoded clue cards through the decoder may allow a user to reveal the order of the rings 1004, 1006, 1008, 1010 of the cryptex 1002. When the cryptex 1002 is solved, it may open up to reveal an item and/or one or more item accessories. Any combination of elements, keys, etc. may be used to create a three-dimensional puzzle where an item is hidden within a cryptex.

FIGS. 11A-11F depict top, bottom, front, rear, right, and left views, respectively, of the puzzle 1000 of FIG. 10, according to one embodiment. While the knob 1016 may be the starting point to solving the puzzle 1000, it may not be apparent to the user where the start and so the user may examine various parts of the puzzle 1000 before discovering that the knob 1016 may be removed.

Figure 12:
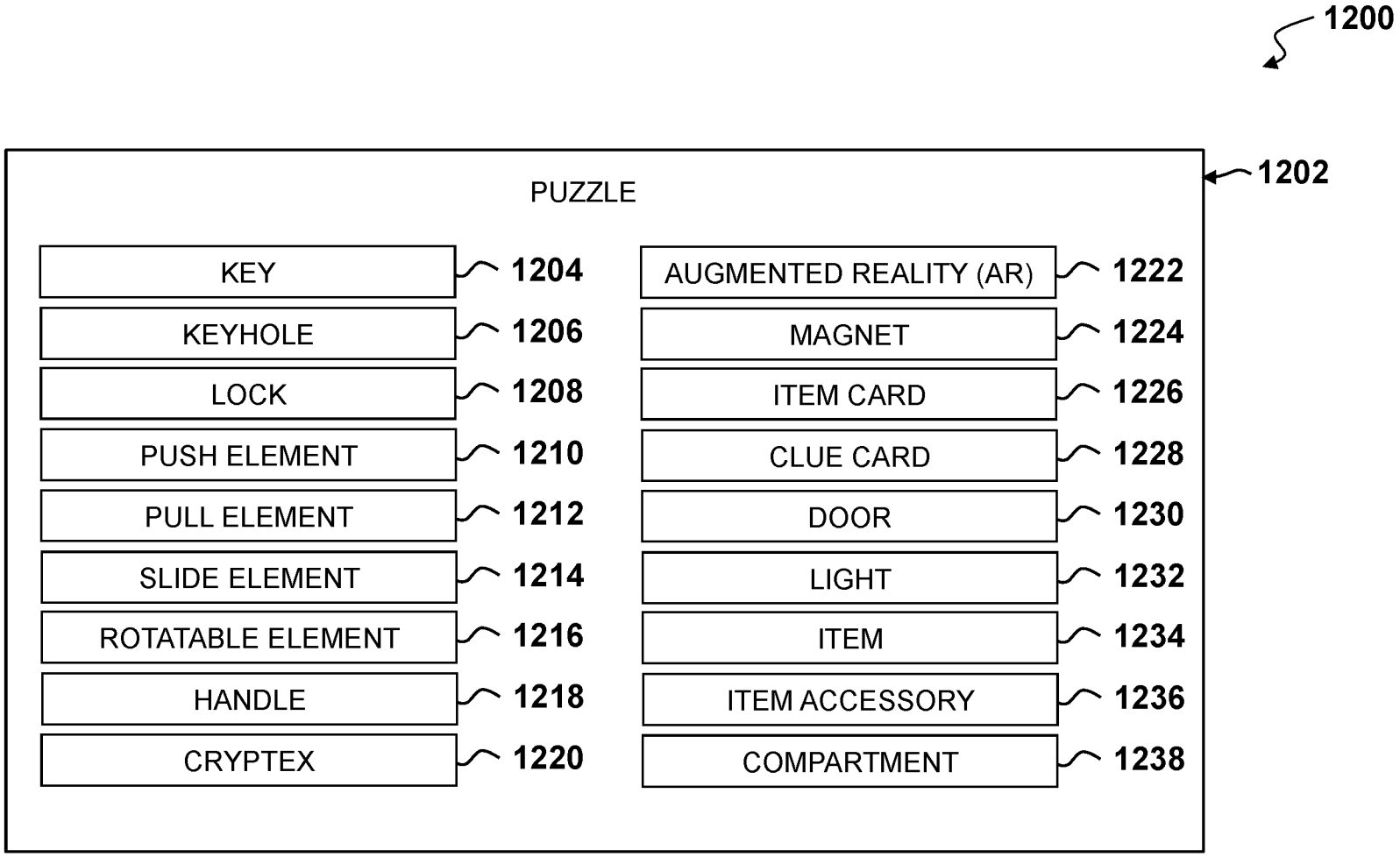
FIG. 12 shows a high-level block diagram of a puzzle system, according to one embodiment.

FIG. 12 shows a high-level block diagram 1200 of a puzzle system 1202, according to one embodiment. The puzzle may include one or more keys 1204, one or more keyholes 1206, one or more locks 1208, one or more push elements 1210, one or more pull elements 1212, one or more slide elements 1214, one or more rotatable elements 1216, one or more handles 1218, one or more cryptex 1220, one or more augmented reality (AR) elements 1222, one or more magnets 1224, one or more item cards 1226, one or more clue cards 1228, one or more doors 1230, one or more lights 1232, one or more items 1234, one or more item accessories 1236, and/or one or more compartments 1238.

Figure 13:
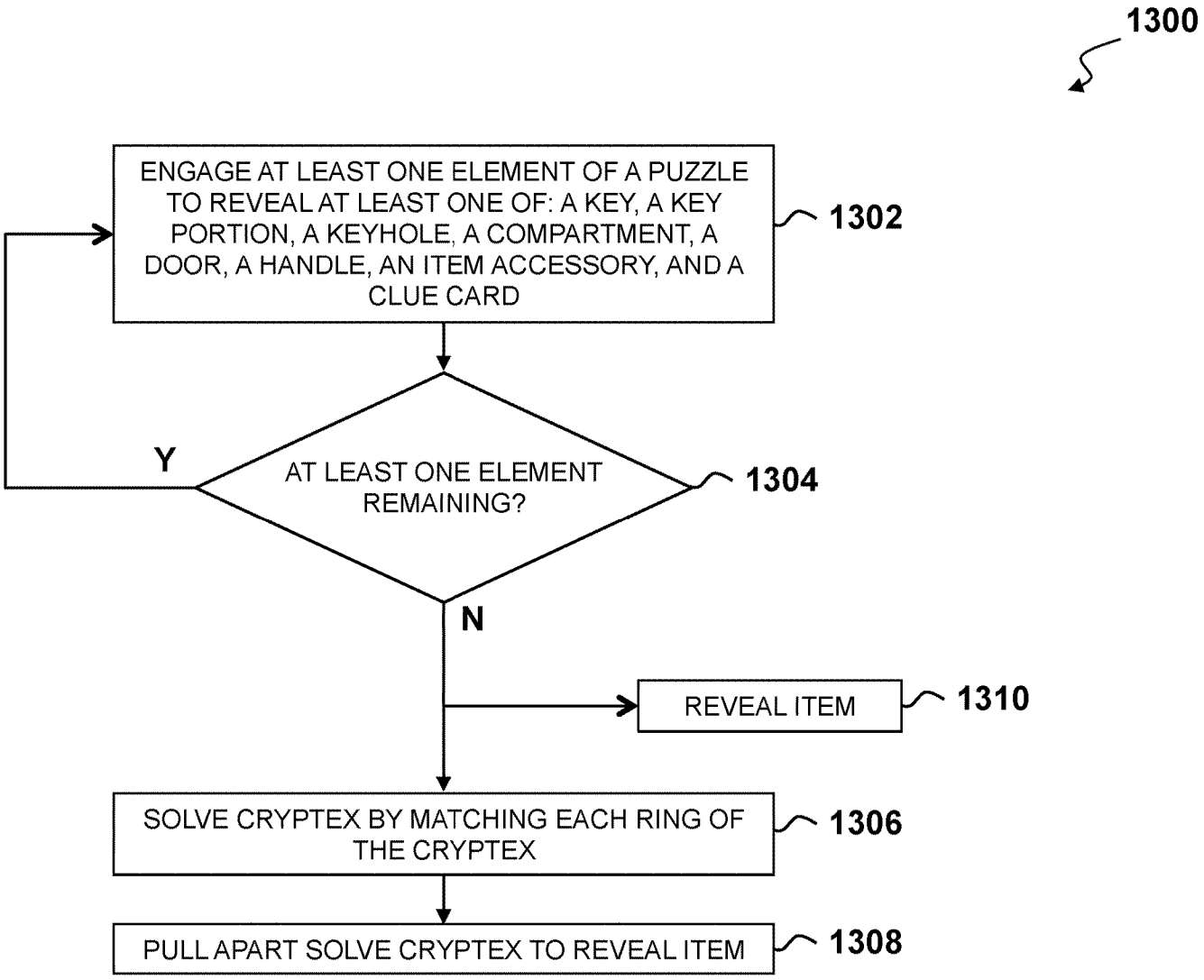
FIG. 13 depicts a high-level flowchart of a method embodiment of solving the puzzle, according to one embodiment.

FIG. 13 depicts a high-level flowchart of a method embodiment 1300 of solving the puzzle, according to one embodiment. At least one element of a puzzle may be engaged to reveal at least one of: a key, a key portion, a keyhole, a compartment, a door, a handle, an item accessory, and a clue card (step 1302). If at least one element is remaining (step 1304), i.e., the puzzle is not solved, then an additional element is engaged (step 1302). This may be repeated until all elements are engaged. The elements of the puzzle to be engaged may include a push element, a pull element, a slide element, a rotatable element, a key, a handle, a magnet, a door, and/or a light. The revealed elements may be used in a linear or non-linear sequence to reveal a cryptex. For example, a pull element may be pulled to reveal a keyhole. Then, a rotatable element may be rotated to reveal a key. The revealed key may then be inserted into the revealed keyhole to uncover a cryptex.

If there are no elements remaining to be engaged (step 1304), then the cryptex may be solved by matching each ring of the cryptex (step 1306). Each ring of the cryptex may be matched by a corresponding clue card, instructions on the puzzle packaging, information revealed on a website or downloadable application, etc.

One each ring of the cryptex has been correctly aligned, the cryptex may be pulled apart to reveal an item (step 1308). The item may be a physical collectible, a code for downloading digital content, a trading card, etc.

In some embodiments, when there are no more elements remaining to be engaged (step 1304), then the item may be revealed (step 1310). While a cryptex is shown in several embodiments, it may not be present in every embodiment disclosed herein. Any combination of elements of the puzzle may be engaged to reveal the item. The elements of the puzzle may include, but are not limited to, a push element, a pull element, a slide element, a rotatable element, a key, a handle, a magnet, a door, a light, and/or an item. The revealed elements may be engaged in a linear or non-linear sequence. In other embodiments, the cryptex may be solved prior to engaging any other combination of elements. For example, instead of an item, the cryptex may reveal a puzzle or additional elements inside the cryptex, and this puzzle may or may not contain an additional cryptex.

Figure 14:
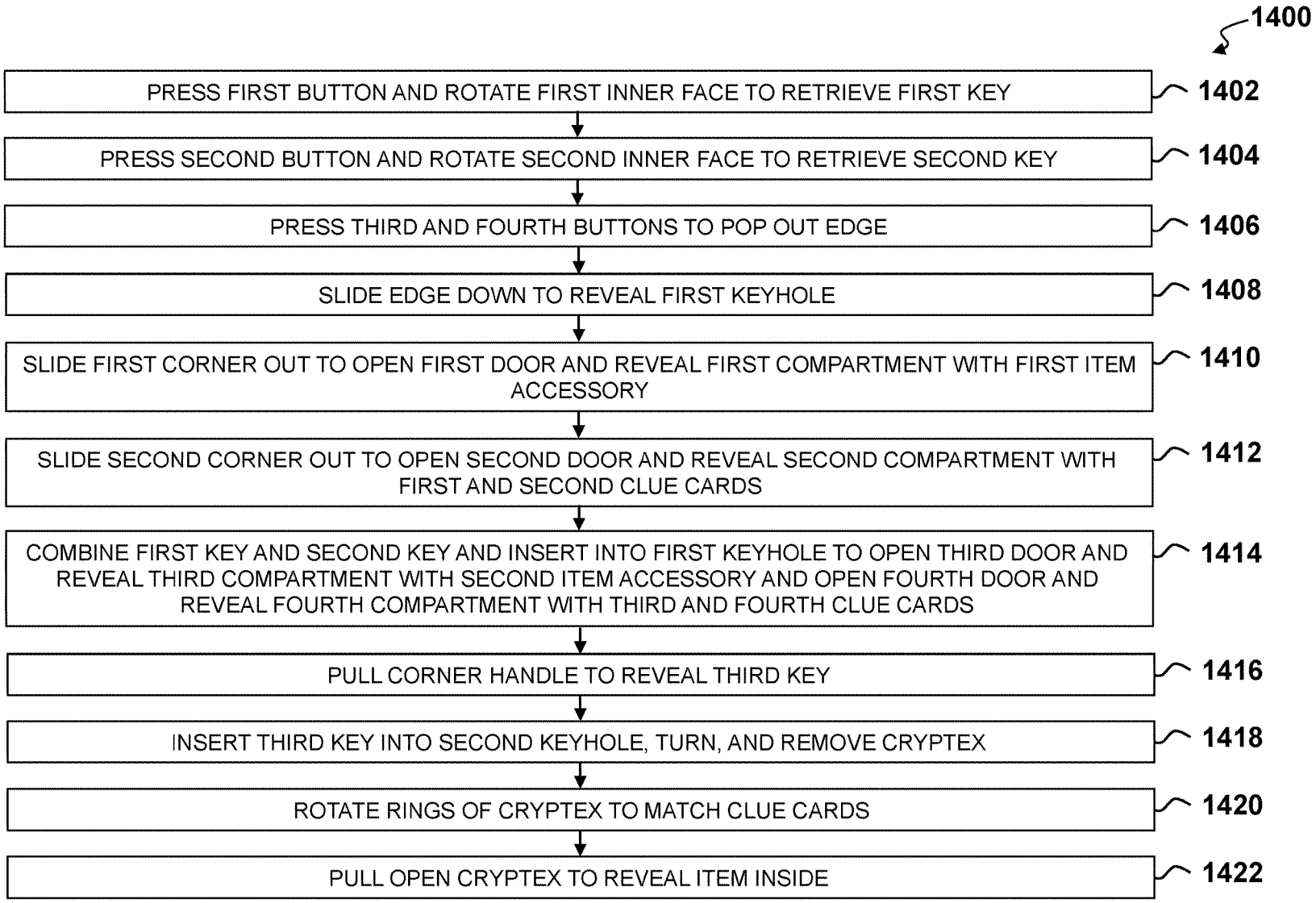
FIG. 14 depicts a flowchart of an alternate method embodiment of solving the puzzle, according to one embodiment.

FIG. 14 depicts a flowchart of an alternate method embodiment 1400 of solving the puzzle, according to one embodiment. A first button may be pressed to rotate a first inner face to retrieve a first key (step 1402). A second button may be pressed and a second inner face may be rotated to retrieve a second key (step 1404). Obtaining the first and second keys is shown in FIG. 2. Third and fourth buttons may be pressed to pop out an edge (step 1406). The edge may be slid down to reveal a first keyhole (step 1408). A first corner may be slid out to open a first door and reveal a first compartment with a first item accessory (step 1410). A second corner may be slid out to open a second door and reveal a second compartment with first and second clue cards (step 1412). Sliding the edge, revealing the keyhole, opening the first and second doors, revealing the first and second compartments, and revealing the item accessory and first and second clue cards is shown in FIG. 3.

The first and second key may be combined to form a combined key that may be inserted into the first keyhole to open a third and fourth door revealing a third and fourth compartment with a second item accessory and third and fourth clue cards (step 1414). Inserting the combined key into the first keyhole and opening the third and fourth doors to reveal the third and fourth compartments is shown in FIG. 4. A corner handle may be pulled to reveal a third key (step 1416). The third key retrieval is shown in FIG. 5. The third key may be inserted into a second keyhole and turned to remove a cryptex (step 1418). The removal of the cryptex via the third key is shown in FIG. 6. The rings of the cryptex may be rotated to match the clue cards (step 1420). The alignment of the rings of the cryptex to match corresponding clue cards is shown in FIG. 7. The solved cryptex may be pulled open to reveal an item inside (step 1422). The revealed item from the solved cryptex is shown in FIG. 8.

Figure 15:
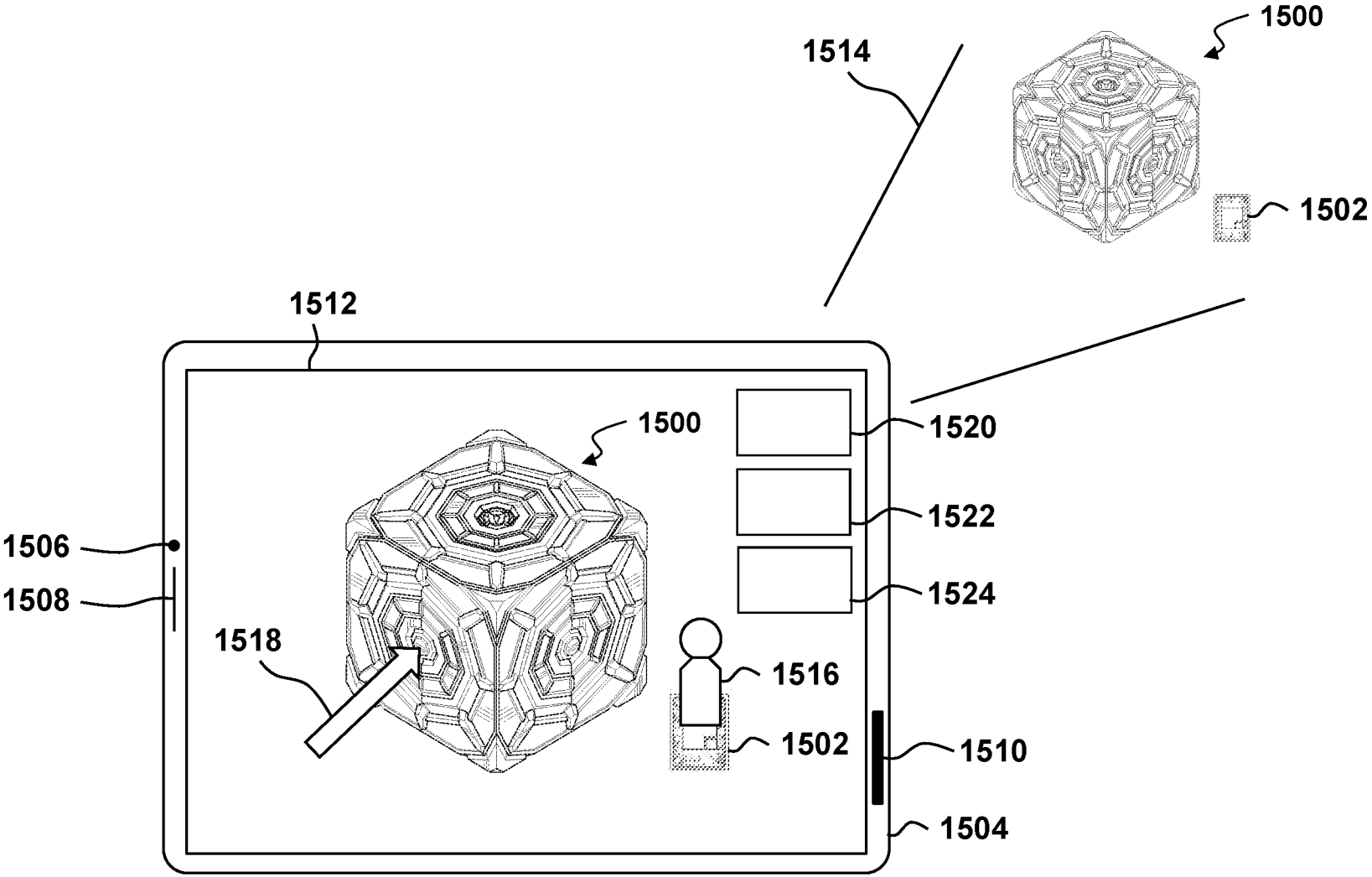
FIG. 15 depicts a computing device utilizing augmented reality (AR) with the puzzle, according to one embodiment.

FIG. 15 depicts a computing device utilizing augmented reality (AR) with the puzzle 1500, according to one embodiment. The puzzle 1500 and one or more elements, such as a clue card 1502 may be placed on a surface. A computing device 1504, such as a tablet, smartphone, laptop computer, desktop computer, glasses, or the like, having a processor with addressable memory may utilize AR with the puzzle 1500 and clue card 1502. The computing device 1504 may include one or more cameras 1506, microphones 1508, speakers 1510, and/or displays 1512. A rear-facing camera (not shown) may have a field of view 1514 that includes the puzzle 1500 and clue card 1502.

The device 1504 display may show the puzzle 1500 and clue card 1502 with one or more additional elements. For example, the item contained in the puzzle 1500 may be displayed 1516 on top of the clue card. The next step, or a hint for the next step, in completing the puzzle 1500 may be displayed 1518. One or more visual elements 1520, 1522, 1524 may also be displayed on the device 1504 display 1512. The visual elements may include a button to complete an action, a link to share on social media, a purchase of additional content, an action of the displayed 1516 item, and the like. The device 1504 may also receive input from the one or more microphone 1508, such as an audio command. The device 1504 may also receive input from the one or more cameras 1506, such as a facial recognition of a user or a user's expression from a front facing camera. The device 1504 may also receive input from a gyroscope of the user based on a movement of the device 1504 relative to ground or relative to the puzzle 1500 and/or clue card 1502. The device 1504 may play video via the display 1512 and/or audio via the one or more speakers 1510, such as a hint or unlocked visual and/or audio content relating to the item 1516. For example, the device 1504 may play a video clip if the user shows all of the clue cards or the item once it has been removed from the solved puzzle 1500.

Figure 16:
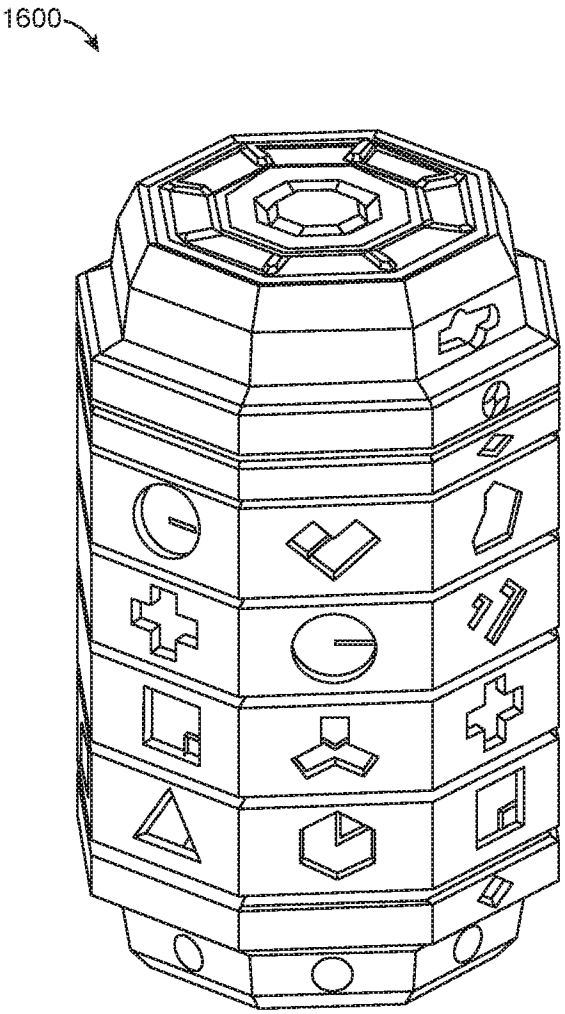
FIG. 16 depicts a perspective view of a puzzle, according to one embodiment.

FIG. 16 depicts a perspective view of a puzzle 1600, according to one embodiment. In some embodiments, the puzzle 1600 may be a cryptex having code rings that may be adjusted to create a new combination for opening or solving the puzzle 1600. The combination of the puzzle 1600 may be adjusted.

Figure 17:
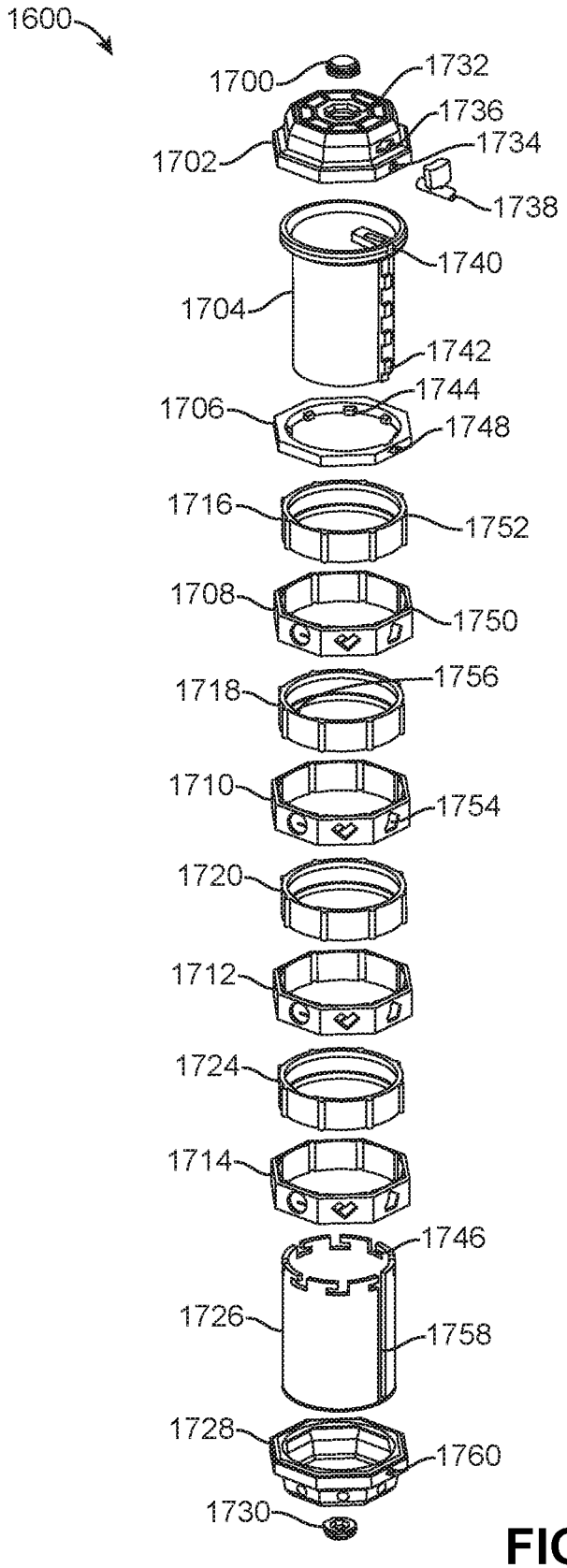
FIG. 17 depicts an exploded perspective view of the puzzle of FIG. 16, according to one embodiment.

FIG. 17 depicts an exploded perspective view of the puzzle 1600 of FIG. 16, according to one embodiment. The puzzle 1600 includes a top key 1700; a first cap 1702; a first cylinder 1704; a securing ring 1706; a plurality of code rings 1708, 1710, 1712, 1714; a plurality of inner combination rings 1716, 1718, 1720, 1724; a second cylinder 1726; a second cap 1728, and a bottom key 1730. The top key 1700 may fit into a first aperture 1732 on the first cap 1702. In some embodiments, the top key 1700 may be a key and the first aperture 1732 may be a keyhole used to unlock a portion of the puzzle 1600. In other embodiments, the top key 1700 may be a piece that covers the first aperture 1732. The first cap 1702 may also include a second aperture 1734 and a first keyhole 1736. The second aperture 1734 may receive a portion of a pin 1738. Pin 1738 may be removed to separate the first cap 1702 from the first cylinder 1704. The first keyhole 1736 may be used with a key (not shown) to unlock a portion of the puzzle 1600.

The first cylinder 1704 may include a third aperture 1740 to receive a portion of the pin 1738. The first cylinder 1704 may also include one or more cylinder protrusions 1742. The number of cylinder protrusions 1742 may correspond to the number of code rings 1708, 1710, 1712, 1714 and/or the number of inner combination rings 1716, 1718, 1720, 1724. The cylinder protrusions 1742 may allow the puzzle 1600 to open when each of the code rings 1708, 1710, 1712, 1714 and/or inner combination rings 1716, 1718, 1720, 1724 are correctly aligned.

The securing ring 1706 may include one or more securing protrusions 1744. The securing protrusions 1744 may be disposed circumferentially about an inner portion of the securing ring 1706. Each securing protrusion 1744 may correspond to a securing channel 1746 on the second cylinder 1726. While protrusions 1744 and channels 1746 are shown, other methods may be used to detachably attach the securing ring 1706 to the second cylinder 1726, such as magnets, hook and loop fasteners, threadable fasteners, friction fit, and the like. The securing ring 1706 may include a securing ring indicator 1748 to provide consistent alignment of the securing ring 1706 when detachably attached to the second cylinder 1726. The securing ring indicator 1748 may be an indentation, protrusion, visual design, or the like. The securing ring indicator 1748 provides a visual indication as to where to align the face of each code ring 1708, 1710, 1712, 1714 to a user when solving the puzzle 1600. The securing ring indicator 1748 may be aligned with the one or more cylinder protrusions 1742 when the puzzle 1600 is assembled.

Each code ring 1708, 1710, 1712, 1714 may include one or more code ring alignment indentations 1750 that may be used to receive one or more corresponding inner combination ring alignment protrusions 1752 of each inner combination ring 1716, 1718, 1720, 1724. The number of code ring alignment indentations 1750 and corresponding inner combination ring alignment protrusions 1752 may be based on the number of sides 1754 of each code ring 1708, 1710, 1712, 1714. Each inner combination ring 1716, 1718, 1720, 1724 may be rotated such that a combination indentation 1756 may be disposed proximate each face 1754 of the code ring 1708, 1710, 1712, 1714. The puzzle 1600 will unlock when each combination indentation 1756 is aligned with each cylinder protrusion 1742. A user may change the combination to unlock the puzzle 1600 by removing the inner combination ring 1716, 1718, 1720, 1724 from the respective code ring 1708, 1710, 1712, 1714; rotating the inner combination ring 1716, 1718, 1720, 1724 relative to the respective code ring 1708, 1710, 1712, 1714; and inserting the inner combination ring 1716, 1718, 1720, 1724 into the respective code ring 1708, 1710, 1712, 1714. The user may change the combination for any number of code rings 1708, 1710, 1712, 1714. In embodiments where the code rings 1708, 1710, 1712, 1714 are not identical, the user may also change the order of the code rings 1708, 1710, 1712, 1714 on the second cylinder 1726.

The second cylinder 1726 may include a channel 1758. The channel 1758 receives the one or more cylinder protrusions 1742 of the first cylinder 1704. The first cylinder 1704 fits inside the second cylinder 1726 with the one or more cylinder protrusions 1742 of the first cylinder 1704 extending beyond an outer diameter of the second cylinder 1726.

The second cap 1728 may include a cap indicator 1760. The cap indicator 1760 may be an indentation, protrusion, visual design, or the like. The cap indicator 1760 provides a visual indication as to where to align the face of each code ring 1708, 1710, 1712, 1714 to a user when solving the puzzle 1600. The cap indicator 1748 may be aligned with the one or more cylinder protrusions 1742 and/or the securing ring indicator 1748 when the puzzle 1600 is assembled. The bottom key 1730 may fit into an aperture (not shown) on the second cap 1728. In some embodiments, the bottom key 1730 may be a key used to unlock a portion of the puzzle 1600. In other embodiments, the bottom key 1730 may be a piece that covers an aperture in the second cap 1728.

Figure 18:
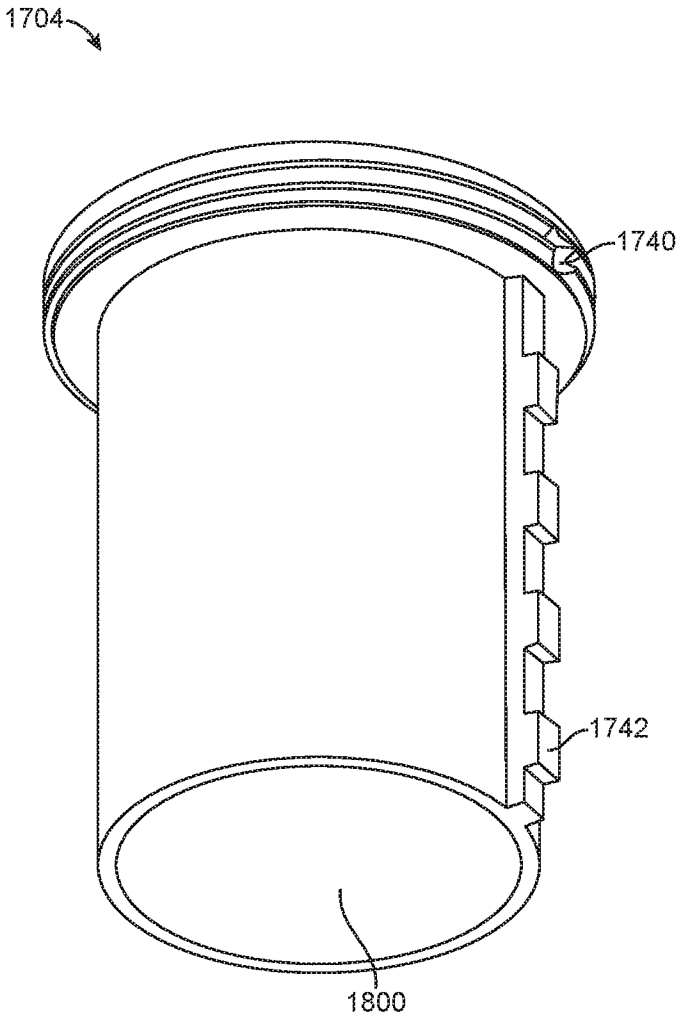
FIG. 18 depicts a perspective view of the first cylinder, according to one embodiment.

FIG. 18 depicts a perspective view of the first cylinder 1704, according to one embodiment. The first cylinder 1704 may include a third aperture 1740 and one or more cylinder protrusions 1742. The first cylinder may also contain a compartment 1800 disposed within the first cylinder 1704. The compartment 1800 may contain an item that is revealed when the puzzle is solved. The item may be a physical collectible, a code for downloading digital content, a trading card, and the like.

Figure 19:
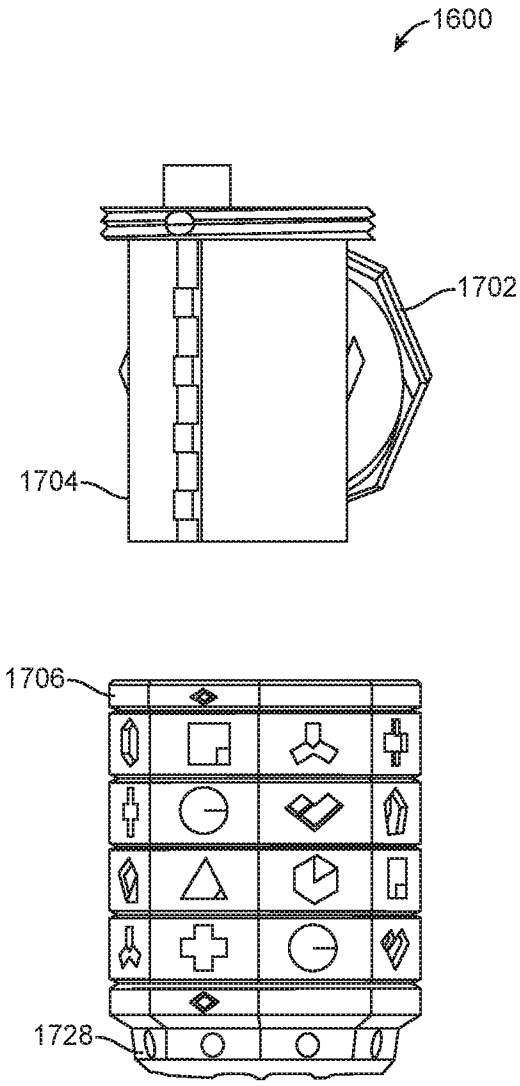
FIG. 19 depicts a side view of the puzzle of FIG. 16 with the first cylinder and top cap removed, according to one embodiment.

FIG. 19 depicts a side view of the puzzle 1600 of FIG. 16 with the first cylinder 1704 and top cap 1704 removed, according to one embodiment. The securing ring 1706 may hold the one or more code rings in place between the securing ring 1706 and the second cap 1728.

Figure 20A:
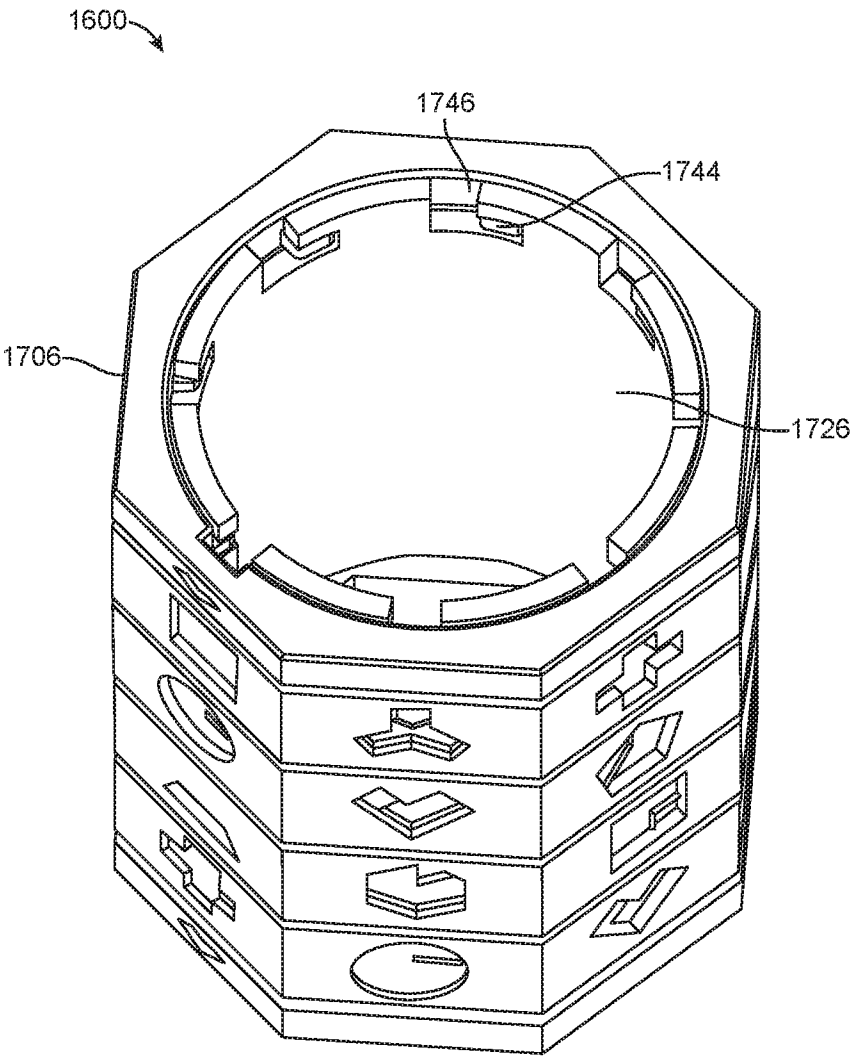
FIG. 20A depicts a top view of the puzzle of FIG. 16 with the securing ring detachably attached to the second cylinder, according to one embodiment.

FIG. 20A depicts a top view of the puzzle 1600 of FIG. 16 with the securing ring 1706 detachably attached to the second cylinder 1726, according to one embodiment. The securing ring 1706 may include one or more securing protrusions 1744. The securing protrusions 1744 may be disposed circumferentially about an inner portion of the securing ring 1706. Each securing protrusion 1744 may correspond to a securing channel 1746 on the second cylinder 1726. While protrusions 1744 and channels 1746 are shown, other methods may be used to detachably attach the securing ring 1706 to the second cylinder 1726, such as magnets, hook and loop fasteners, threadable fasteners, friction fit, and the like.

Figure 20B:
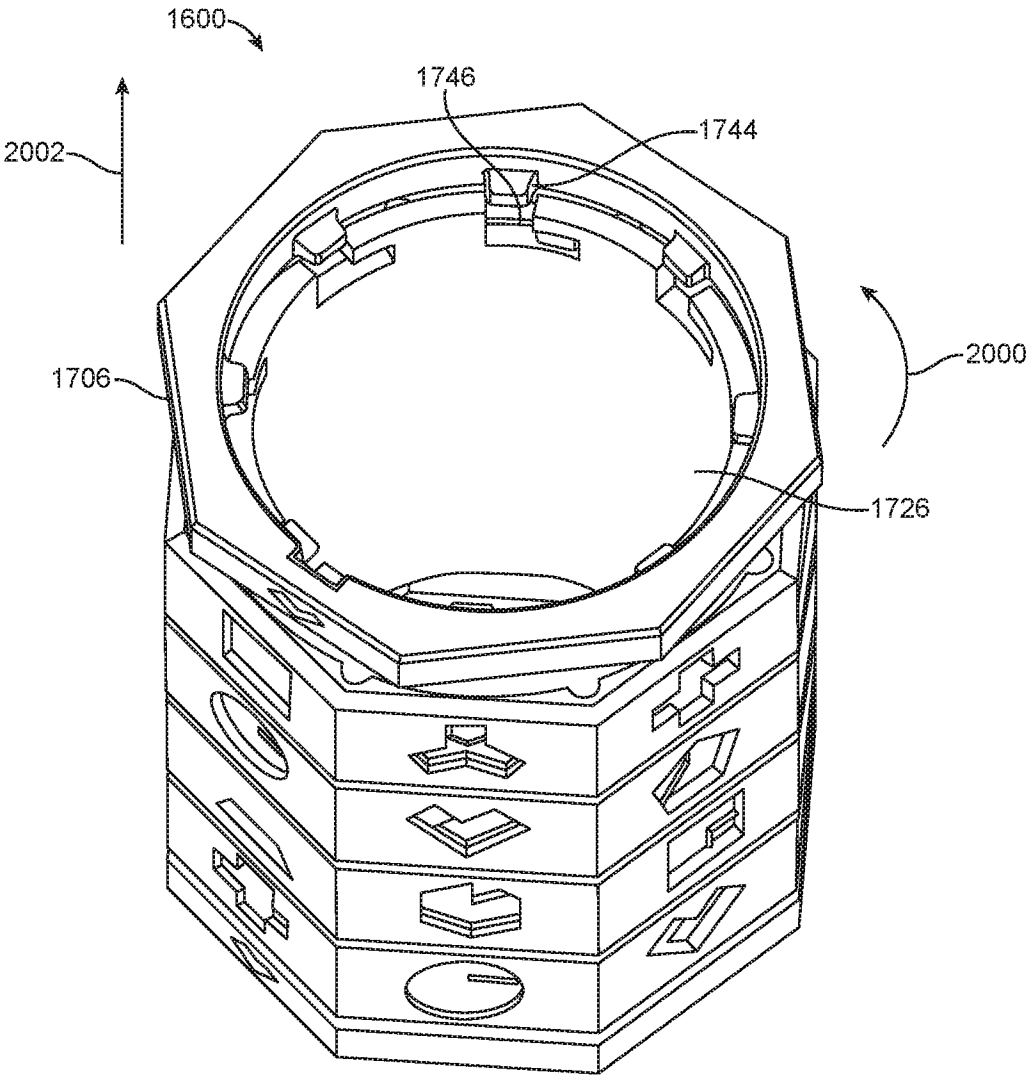
FIG. 20B depicts a top view of the puzzle of FIG. 16 with the securing ring detached from the second cylinder, according to one embodiment.

FIG. 20B depicts a top view of the puzzle 1600 of FIG. 16 with the securing ring 1706 detached from the second cylinder 1726, according to one embodiment. The securing ring 1706 is rotated 2000 relative to the second cylinder 1726 to move the one or more securing protrusions 1744 in the respective channels 1746 of the second cylinder 1726. The channel 1746 ensures that the securing ring 1706 is not accidentally removed, such as by an upward force relative to the second cylinder 1746. Once the securing ring 1706 is rotated 2000, the securing ring 1706 is pulled apart 2002 from the second cylinder 1726.

Figure 20C:
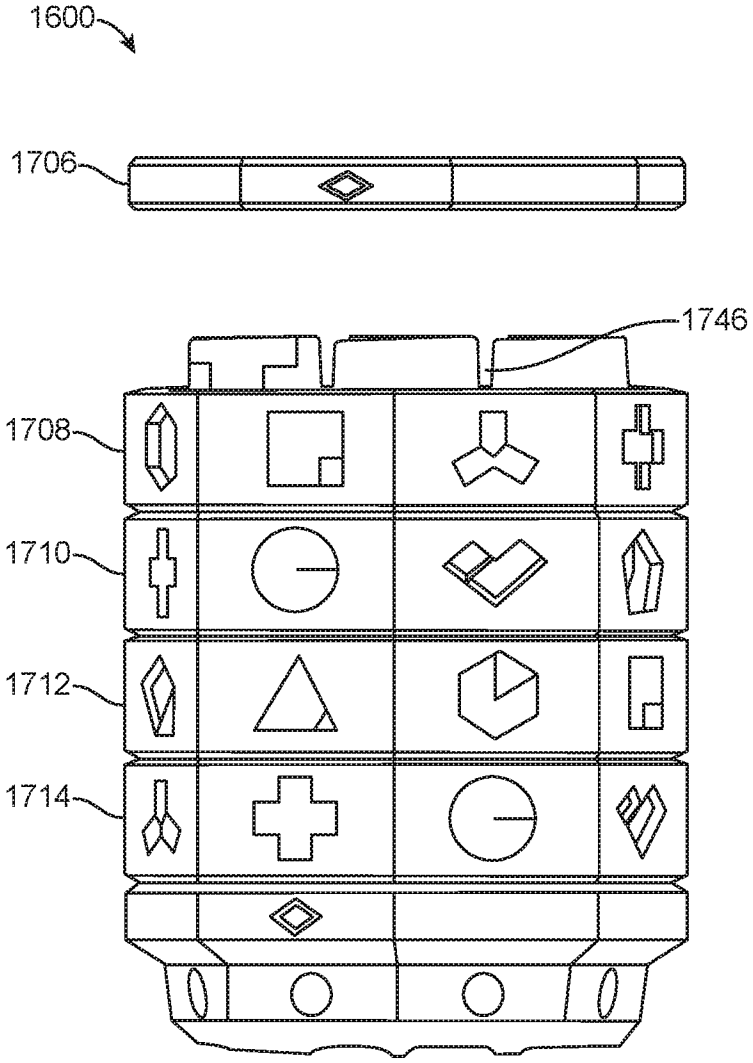
FIG. 20C depicts a side view of the puzzle of FIG. 16 with the securing ring detached from the second cylinder, according to one embodiment.

FIG. 20C depicts a side view of the puzzle of FIG. 16 with the securing ring 1706 detached from the second cylinder 1746, according to one embodiment. The code rings 1708, 1710, 1712, 1714 are disposed about the outer surface of the second cylinder 1746.

Figure 21A:
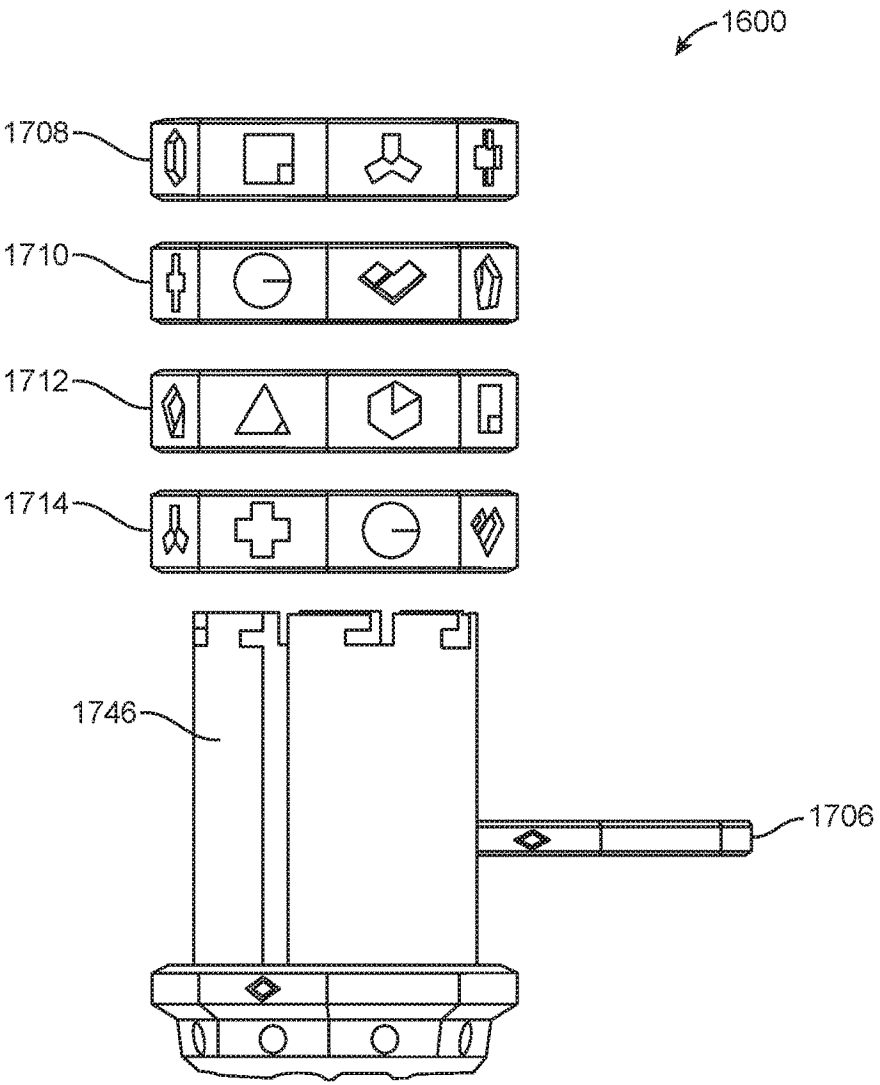
FIG. 21A depicts a side view of the puzzle of FIG. 16 with the plurality of code rings removed from the second cylinder, according to one embodiment.

FIG. 21A depicts a side view of the puzzle 1600 of FIG. 16 with the plurality of code rings 1708, 1710, 1712, 1714 removed from the second cylinder 1746, according to one embodiment. The securing ring 1706 remains removed from the second cylinder 1746.

Figure 21B:
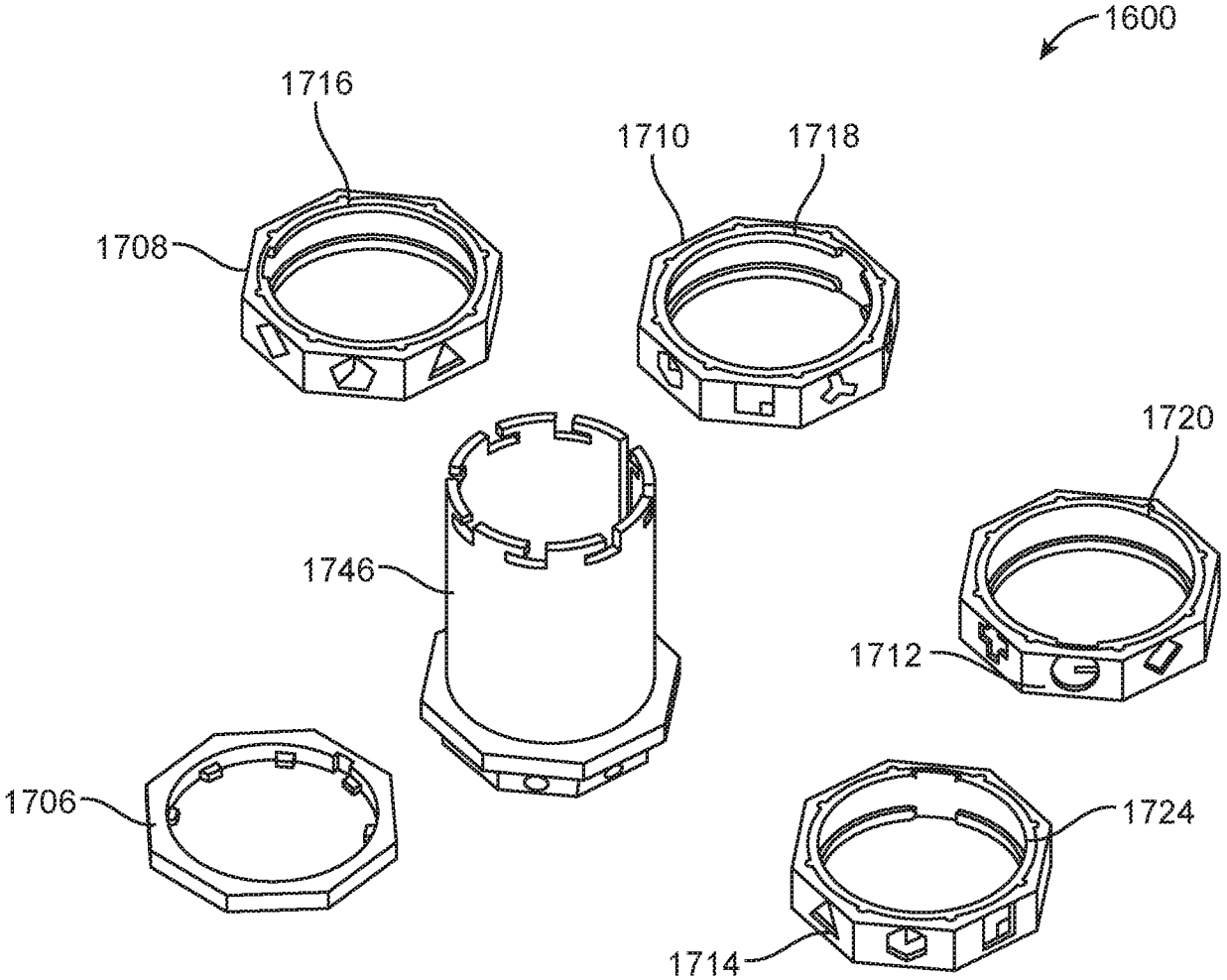
FIG. 21B depicts a perspective view of the puzzle of FIG. 16 with the plurality of code rings removed from the second cylinder, according to one embodiment.

FIG. 21B depicts a perspective view of the puzzle of FIG. 16 with the plurality of code rings 1708, 1710, 1712, 1714 removed from the second cylinder 1746, according to one embodiment. The one or more inner combination rings 1716, 1718, 1720, 1724 are disposed in each respective code ring 1708, 1710, 1712, 1714. The securing ring 1706 remains removed from the second cylinder 1746. In some embodiments, each code ring 1708, 1710, 1712, 1714 may be replaced on the second cylinder 1746 in any desired order. In other embodiments, each code ring 1708, 1710, 1712, 1714 may contain a unique identifier (not shown) to ensure that the order may be tracked by the user.

Figure 22A:
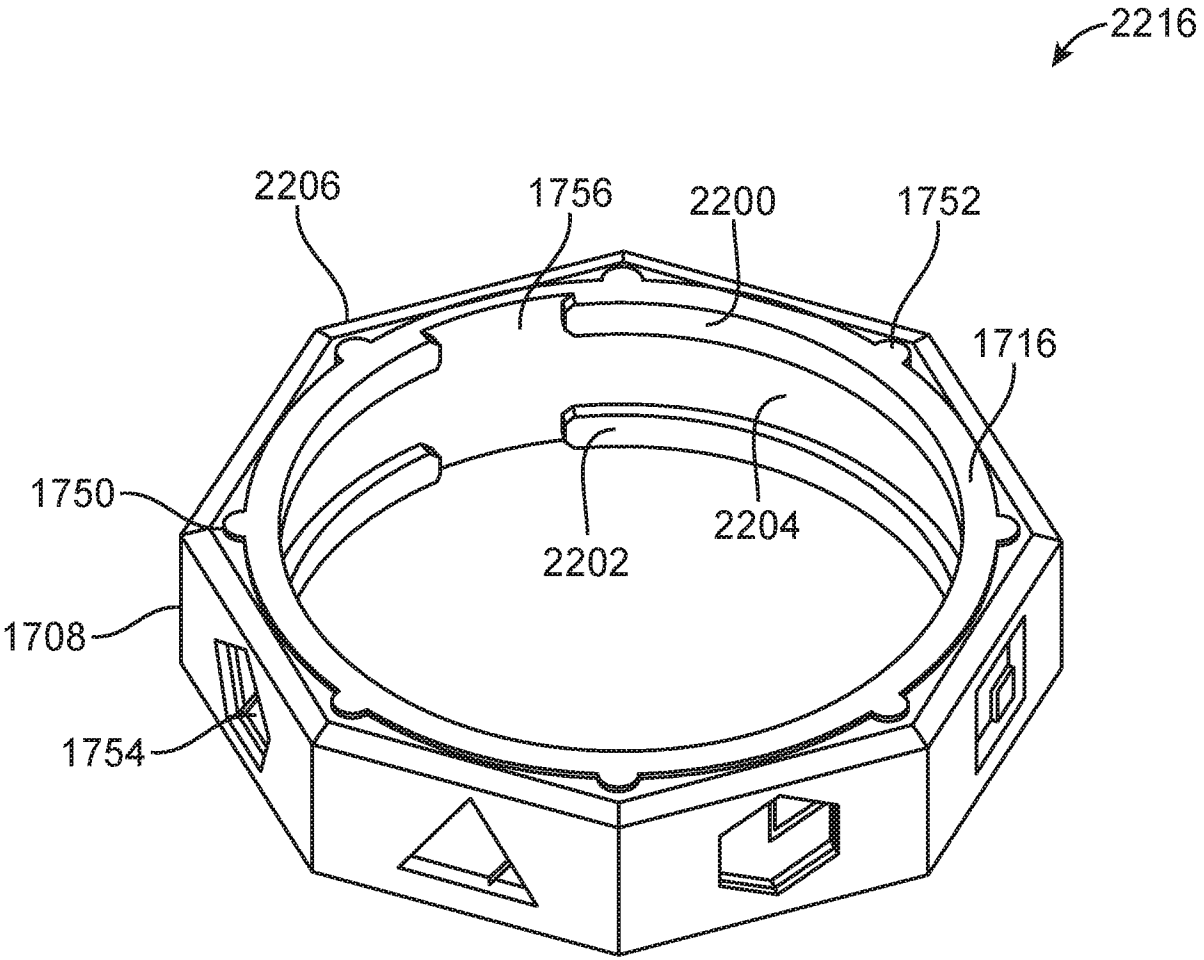
FIG. 22A depicts a perspective view of the code ring and the inner combination ring in a first combination, according to one embodiment.

FIG. 22A depicts a perspective view of the code ring 1708 and the inner combination ring 1716 in a first combination 2216, according to one embodiment. The code ring 1708 may include one or more code ring alignment indentations 1750 that may be used to receive one or more corresponding inner combination ring alignment protrusions 1752 of the inner combination ring 1716. The number of code ring alignment indentations 1750 and corresponding inner combination ring alignment protrusions 1752 may be based on the number of sides 1754 of the code ring 1708. The inner combination ring 1716 may be rotated such that the combination indentation 1756 may be disposed proximate each face 1754 of the code ring 1708. The unlocked side 2206 of the code ring 1708 is the side proximate the combination indentation 1756 of the inner combination ring 1716. The inner surface of the inner combination ring 1716 may contain a first border 2200 and a second border 2202. The first border 2200 and the second border 2202 may form a channel 2204. The cylinder protrusion (1742, See FIG. 2) may fit within the channel 2204. The combination indentation 1756 intersects the first and second borders 2200, 2202 allowing the cylinder protrusion to move past the first and second borders 2200, 2202 when the cylinder protrusion is disposed in the combination indentation 1756. By moving the position of the combination indentation 1756 relative to the faces of the code ring 1708, the combination needed to unlock the puzzle may be varied.

Figure 22B:
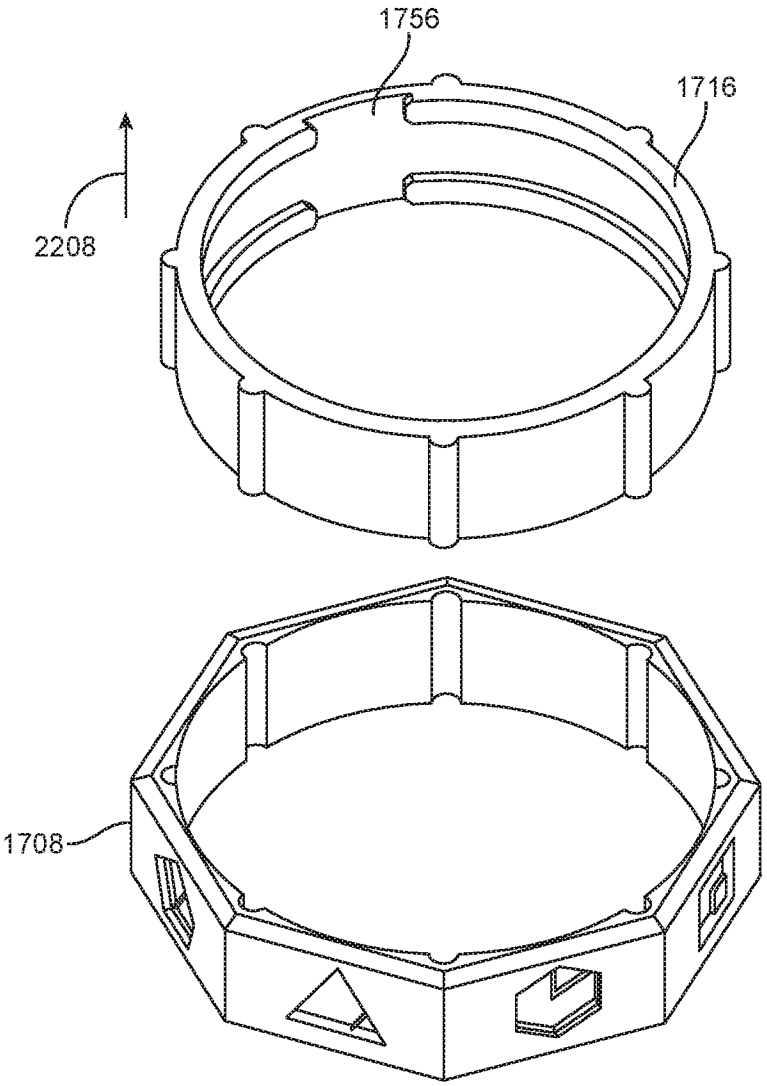
FIG. 22B depicts a perspective view of the inner combination ring removed from the code ring, according to one embodiment.

FIG. 22B depicts a perspective view of the inner combination ring 1716 removed from the code ring 1708, according to one embodiment. The inner combination ring 1716 is pulled apart 2208 from the code ring 1708.

Figure 22C:
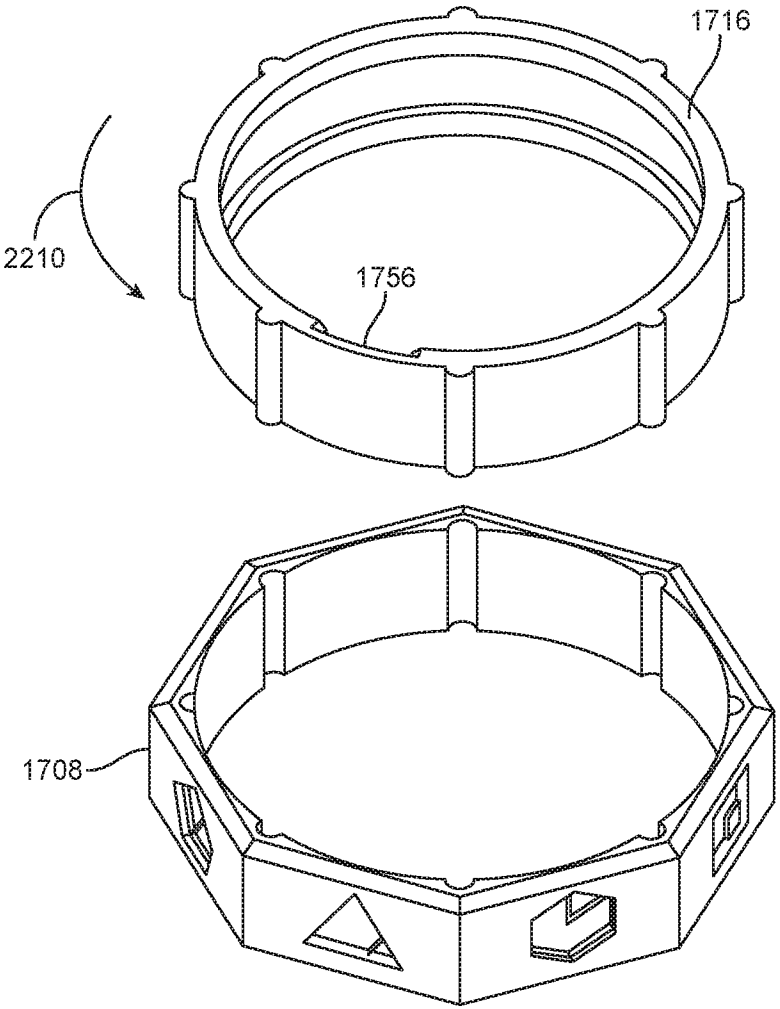
FIG. 22C depicts a perspective view of the inner combination ring rotated relative to the code ring, according to one embodiment.

FIG. 22C depicts a perspective view of the inner combination ring 1716 rotated relative to the code ring 1708, according to one embodiment. The inner combination ring 1716 is rotated 2210 relative to the inner combination ring 1708 such that the combination indentation 1756 is reoriented relative to the faces of the code ring 1708.

Figure 22D:
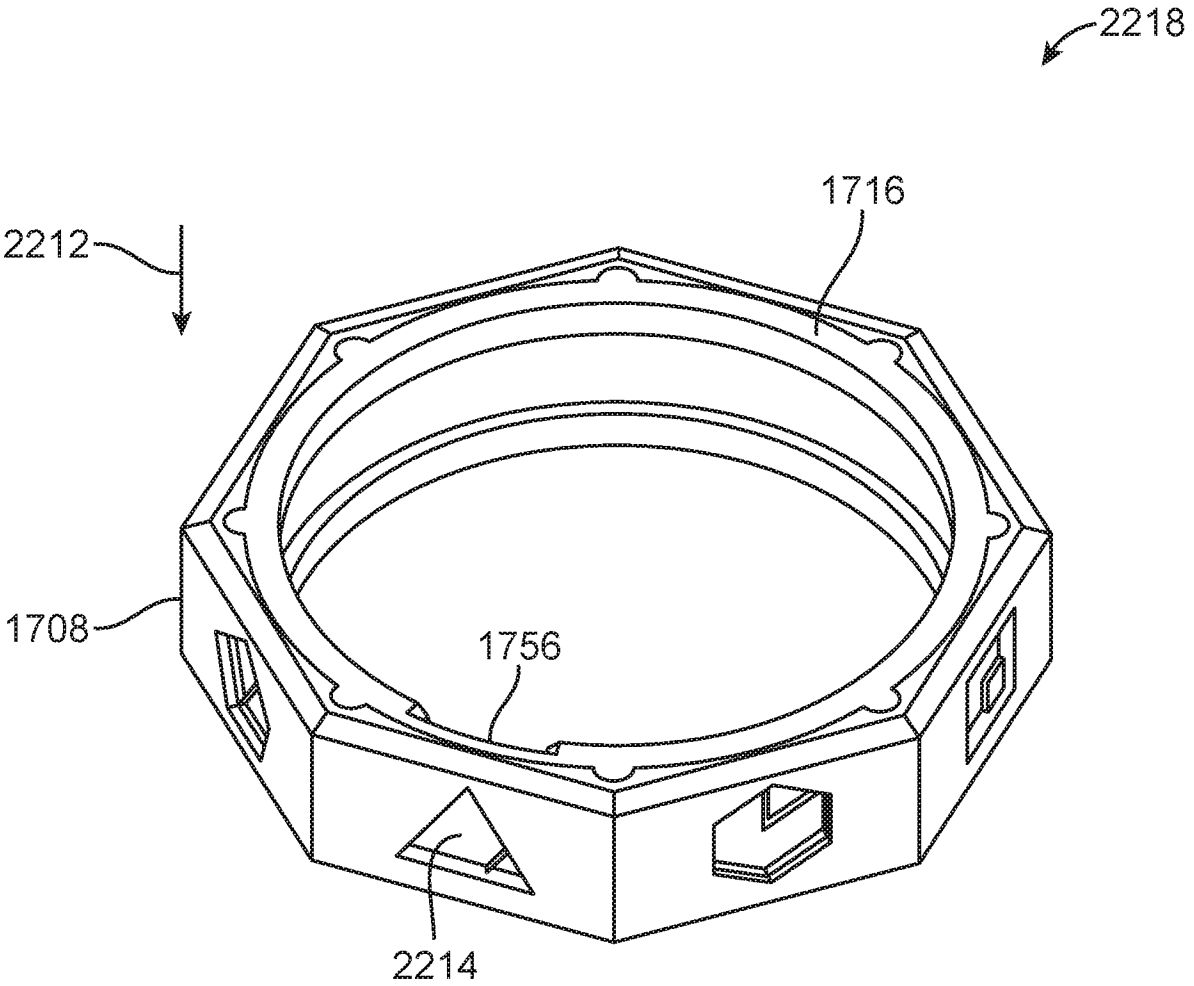
FIG. 22D depicts a perspective view of the inner combination ring inserted into the code ring in a second combination, according to one embodiment.

FIG. 22D depicts a perspective view of the inner combination ring 1716 inserted into the code ring 1708 in a second combination 2218, according to one embodiment. The inner combination ring 1716 is inserted 2212 into the code ring 1708 such that the combination indentation 1756 is proximate a new face 2214 of the code ring 1708. When the puzzle is reassembled, the new face 2214 will be part of the correct combination to unlock the puzzle.

Figure 23C:
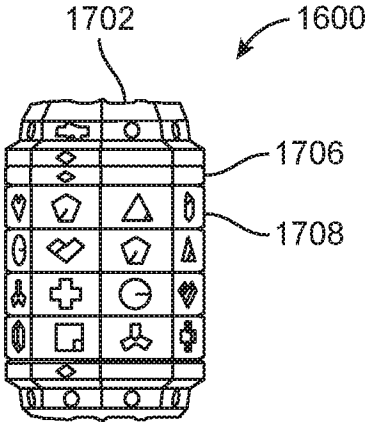
FIG. 23C depicts a side view of the reassembled puzzle of FIG. 16 having a new combination, according to one embodiment.
Figure 23B:
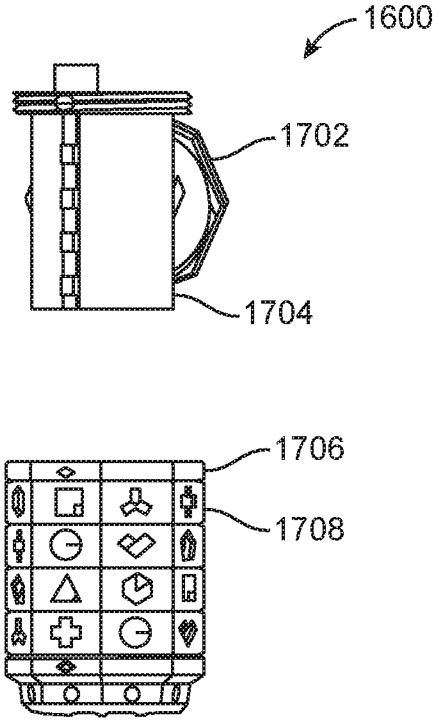
FIG. 23B depicts a side view of the puzzle of FIG. 16 with the securing ring attached to the second cylinder, according to one embodiment.
Figure 23A:
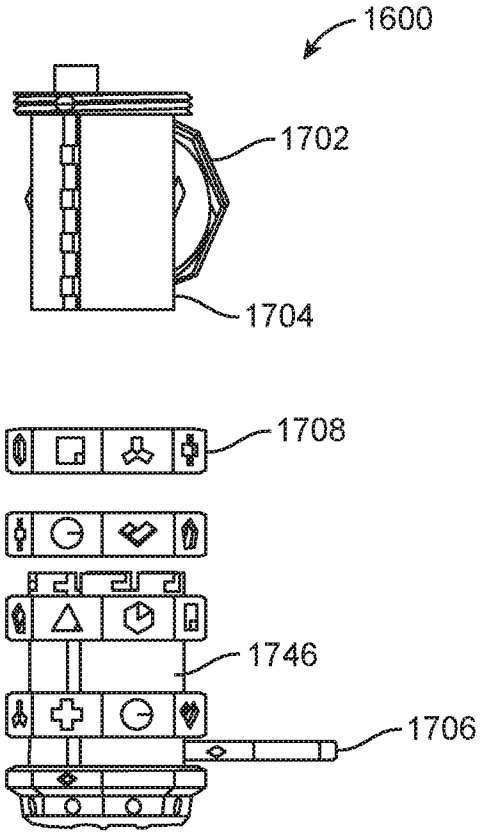
FIG. 23A depicts a side view of the puzzle of FIG. 16 with the plurality of code rings being inserted about the second cylinder, according to one embodiment.

FIG. 23A depicts a side view of the puzzle 1600 of FIG. 16 with the plurality of code rings 1708 being inserted about the second cylinder 1746, according to one embodiment. FIG. 23B depicts a side view of the puzzle 1600 of FIG. 16 with the securing ring 1706 attached to the second cylinder, according to one embodiment. FIG. 23C depicts a side view of the reassembled puzzle 1600 of FIG. 16 having a new combination, according to one embodiment.

Figure 24:
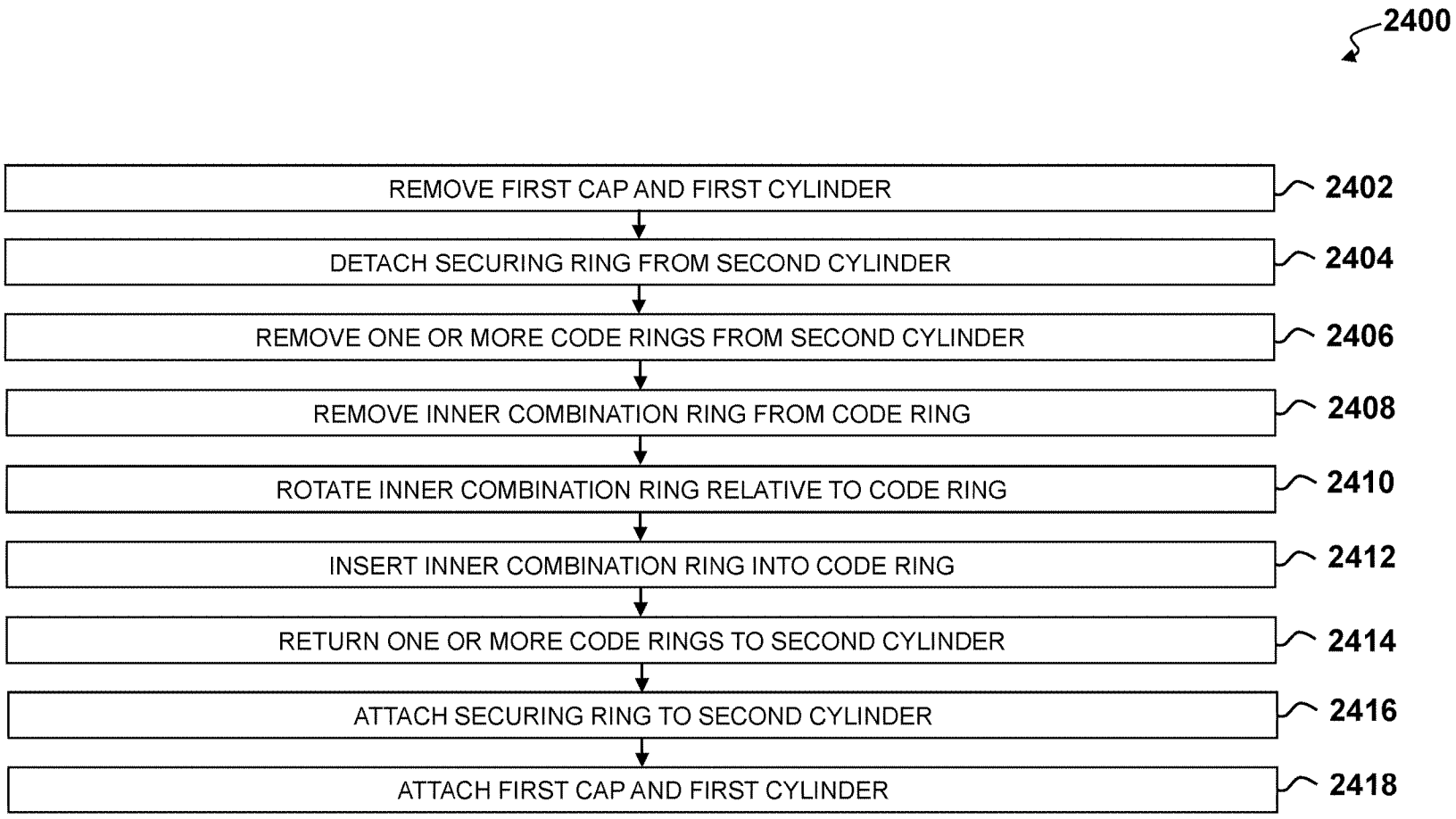
FIG. 24 depicts a flowchart of a method embodiment of solving the puzzle, according to one embodiment.

FIG. 24 depicts a flowchart of a method embodiment 2400 of solving the puzzle, according to one embodiment. The method 2400 may include removing a first cap and a first cylinder from a second cylinder (step 2402). In some embodiments, the first cap and first cylinder may already be removed, such as after the puzzle has been solved. Then, a securing ring may be detached from the second cylinder (step 2404). The securing ring may ensure that any code rings are not inadvertently removed from the puzzle, such as when the puzzle has been solved. In some embodiments, the securing ring may not be a component. One or more code rings are then removed from the second cylinder (step 2406). There may be between one and twelve code rings in some embodiments. In some embodiments, there may be two or more code rings to prevent the ability to easily brute force the combination without following clues or hints to open the puzzle. In some embodiments, there may be four code rings to prevent the ability to easily brute force the combination without following clues or hints to open the puzzle. An inner combination ring may be removed from a code ring of the one or more code rings (step 2408). In some embodiments, all inner combination rings may be removed and the solution for each code ring may be changed. The inner combination ring may be rotated relative to the code ring (step 2410). The inner combination ring may then be inserted back into the code ring (step 2412). The new orientation of the inner combination ring relative to the code ring creates a new solution for unlocking the code ring as part of the puzzle. The one or more code rings are returned to the second cylinder (step 2414). In some embodiments, the code rings may be returned in the same order. In other embodiments, the code rings may be returned in a different order than the order they were in prior to being removed. The securing ring may be attached to the second cylinder (step 2416). The first cap and the first cylinder may be reattached to the second cylinder (step 2415). In some embodiments, a same or new item may be placed inside the first cylinder prior to reattaching the first cap and first cylinder.

Figure 25:
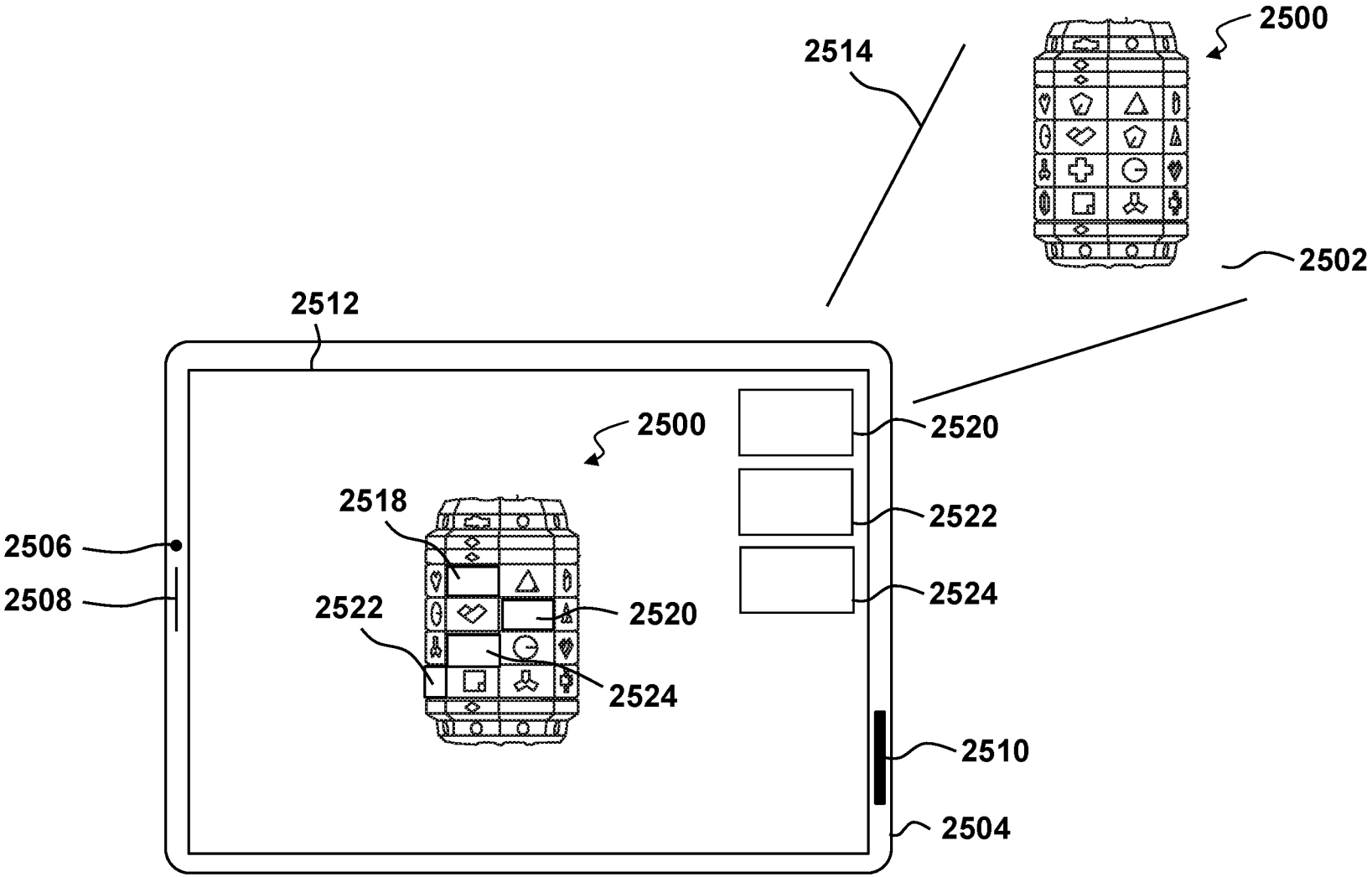
FIG. 25 depicts a computing device utilizing augmented reality (AR) to change a combination of the puzzle, according to one embodiment.

FIG. 25 depicts a computing device utilizing augmented reality (AR) to change a combination of the puzzle 2500, according to one embodiment. The puzzle 2500 may be placed on a surface 2502. A computing device 2504, such as a tablet, smartphone, laptop computer, desktop computer, glasses, or the like, having a processor with addressable memory may utilize AR with the puzzle 2500. The computing device 2504 may include one or more cameras 2506, microphones 2508, speakers 2510, and/or displays 2512. A rear-facing camera (not shown) may have a field of view 2514 that includes the puzzle 2500.

The device 2504 display may show the puzzle 2500 with one or more additional elements. One or more visual elements 2520, 2522, 2524 may also be displayed on the device 2504 display 2512. The visual elements may include a button to complete an action, a link to share on social media, a purchase of additional content, instructions for unlocking the puzzle, instructions for changing the combination to unlock the puzzle, and the like. The device 2504 may also receive input from the one or more microphones 2508, such as an audio command. The device 2504 may also receive input from the one or more cameras 2506, such as a facial recognition of a user or a user's expression from a front-facing camera. The device 2504 may also receive input from a gyroscope of the user based on a movement of the device 2504 relative to ground or relative to the puzzle 2500. The device 2504 may play video via the display 2512 and/or audio via the one or more speakers 2510, such as a hint or unlocked visual and/or audio content.

In some embodiments, one or more sides 2518, 2520, 2522, 2524 and/or rings of the puzzle 2500 may contain a same or blank indicator or design. The user may need to use AR to view the indicator or design on these sides via the display 2512 of the device 2504. The user may change the combination of the puzzle 2500 without removing any elements by selecting or swapping these indicators or designs that are only visible via AR on the device 2504.

In other embodiments, the puzzle 2500 may use a combination of physical indicators and virtual indicators. In other embodiments, the user may save the updated combination and others may view the updated combination, or hints to solving the puzzle 2500, via the device 2504.

In other embodiments, one or more rings of the puzzle 2500 may be swapped with one or more additional rings. For example, an additional ring having the same or different indicators may replace an existing ring.

In additional embodiments, the device 2504 may display one or more additional puzzles to be solved before or after the puzzle 2500 is unlocked. For example, an additional AR ring or puzzle may need to be solved on the device 2504 before the user is presented with the correct combination for one or more rings of the puzzle 2500.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A system comprising:

one or more code rings, each code ring comprising one or more sides on an outer surface and one or more code ring alignment indentations on an inner surface;

one or more inner combination rings, each inner combination ring comprising one or more inner combination ring alignment protrusions on an outer surface and a combination indentation on an inner surface;

a first cylinder comprising one or more cylinder protrusions; and a second cylinder comprising a channel, wherein the first cylinder fits inside the second cylinder, wherein the one or more cylinder protrusions of the first cylinder extend beyond an outer diameter of the second cylinder, wherein the one or more code rings are disposed about the second cylinder, wherein the one or more cylinder protrusions of the first cylinder fit into each combination indentation on the inner surface of each of the one or more inner combination rings, wherein each of the one or more code ring alignment indentations receive each of the one or more inner combination ring alignment protrusions, wherein each inner combination ring is removable and rotatable relative to each code ring of the one or more code rings, and wherein the combination indentation is proximate an unlocked side of each of the one or more code rings.

2. The system of claim 1, wherein the one or more code rings comprise two or more code rings.

3. The system of claim 2, wherein the one or more inner combination rings comprise two or more inner combination rings.

4. The system of claim 1 further comprising:

a securing ring detachably attached to the second cylinder, wherein the one or more code rings are disposed about the second cylinder, and wherein the securing ring holds the one or more code rings in place about the second cylinder.

5. The system of claim 4 further comprising:

a top key; and a first cap, wherein the first cap is attached to the first cylinder, and wherein the top key is configured to detach the first cap from the first cylinder.

6. The system of claim 1 further comprising:

a first border disposed on an inner surface of each of the one or more inner combination rings; and a second border disposed on an inner surface of each of the one or more inner combination rings;

wherein the first border and the second border form another channel, and wherein the one or more cylinder protrusions of the first cylinder fit within the other channel when the combination indentation is proximate a locked side of the code ring.

7. The system of claim 1, wherein the first cylinder is detachable from the second cylinder when the unlocked side of each of the one or more code rings is aligned with the one or more cylinder protrusions of the first cylinder.

8. The system of claim 1, wherein a combination to detach the first cylinder from the second cylinder may be varied by rotation of each inner combination ring relative to each code ring of the one or more code rings, wherein the combination comprises the unlocked side of each of the one or more code rings aligned with each of the one or more cylinder protrusions of the first cylinder.

* * * * *